US006358596B1

(12) United States Patent
Mehta et al.

(10) Patent No.: US 6,358,596 B1
(45) Date of Patent: Mar. 19, 2002

(54) MULTI-FUNCTIONAL TRANSPARENT SECURE MARKS

(75) Inventors: Rajendra Mehta, Centerville; Watson L. Gullett, Spring Valley; David E. Washburn, Kettering; A. Dale Lakes, Dayton, all of OH (US)

(73) Assignee: The Standard Register Company, Dayton, OH (US)

( * ) Notice: Subject to any disclaimer, the term of this patent is extended or adjusted under 35 U.S.C. 154(b) by 0 days.

(21) Appl. No.: 09/300,118

(22) Filed: Apr. 27, 1999

(51) Int. Cl.[7] ..... B32B 3/00

(52) U.S. Cl. ..... 428/172; 428/195; 428/211; 428/537

(58) Field of Search ..... 428/211, 172, 428/195, 537

(56) References Cited

U.S. PATENT DOCUMENTS

| | | | | |
|---|---|---|---|---|
| 2,370,186 | A | 2/1945 | Oldofredi | 101/28 |
| 2,760,863 | A | 8/1956 | Plambeck, Jr. | 95/5.6 |
| 3,043,805 | A | 7/1962 | Burg | 260/72 |

(List continued on next page.)

FOREIGN PATENT DOCUMENTS

| | | |
|---|---|---|
| JP | 3230996 | 10/1991 |

*Primary Examiner*—Bruce H. Hess
*Assistant Examiner*—B. Shewareged
(74) *Attorney, Agent, or Firm*—Killworth, Gottman, Hagan & Schaeff, LLP

(57) ABSTRACT

A cellulosic sheet suitable for use as a security document is provided including a multi-functional transparent secure mark formed therein. In accordance with one embodiment of the present invention the secure mark comprises a transparentized portion of the substrate. The cellulosic substrate defines first and second major faces. The transparentized portion comprises a transparentizing composition applied to the cellulosic substrate in a predetermined pattern so as to define a graphical image having a relative transparency selected so as to define an area of increased transparency in the substrate. The transparentizing composition comprises a transparentizing agent and a security agent. In one embodiment of the present invention, the transparentized portion includes a printed portion and printed matter defining the printed portion is covered by the transparentizing composition.

35 Claims, 2 Drawing Sheets

U.S. PATENT DOCUMENTS

| | | | | | |
|---|---|---|---|---|---|
| 3,261,686 | A | | 7/1966 | Celeste et al. | 96/115 |
| 3,380,831 | A | | 4/1968 | Cohen et al. | 96/115 |
| 3,469,982 | A | | 9/1969 | Celeste | 96/35.1 |
| 3,661,576 | A | | 5/1972 | Crary | 96/35.1 |
| 3,813,261 | A | | 5/1974 | Muller | 117/153 |
| 3,985,927 | A | | 10/1976 | Norris et al. | 428/211 |
| 4,128,437 | A | | 12/1978 | Ura et al. | 106/287.24 |
| 4,137,046 | A | | 1/1979 | Koike et al. | 8/192 |
| 4,198,465 | A | | 4/1980 | Moore et al. | 428/409 |
| 4,210,346 | A | | 7/1980 | Mowry, Jr. et al. | 283/8 B |
| 4,237,185 | A | | 12/1980 | Lombardi et al. | 428/337 |
| 4,271,227 | A | | 6/1981 | Muller et al. | 428/264 |
| 4,319,009 | A | | 3/1982 | Friedli et al. | 526/62 |
| 4,362,848 | A | | 12/1982 | Friedli et al. | 525/193 |
| 4,416,950 | A | | 11/1983 | Muller et al. | 428/537 |
| 4,513,056 | A | | 4/1985 | Vernois et al. | 428/264 |
| 4,526,803 | A | | 7/1985 | White | 427/14.1 |
| 4,569,888 | A | | 2/1986 | Muller et al. | 428/481 |
| 4,720,325 | A | | 1/1988 | Rausing et al. | 162/110 |
| 4,729,506 | A | | 3/1988 | Neubauer | 229/69 |
| 4,760,239 | A | | 7/1988 | Makin | 219/121.85 |
| 4,761,435 | A | | 8/1988 | Murphy et al. | 522/46 |
| 4,814,043 | A | | 3/1989 | Rausing et al. | 162/286 |
| 4,824,486 | A | | 4/1989 | Lafler | 106/30 |
| 4,919,044 | A | | 4/1990 | Lafler | 101/141 |
| 4,956,225 | A | | 9/1990 | Malhotra | 428/216 |
| 4,997,697 | A | | 3/1991 | Malhotra | 428/195 |
| 5,017,666 | A | * | 5/1991 | Crano et al. | 526/230.5 |
| 5,055,354 | A | | 10/1991 | Simcoke | 428/342 |
| 5,085,936 | A | | 2/1992 | Herdman | 428/337 |
| 5,118,526 | A | | 6/1992 | Allen et al. | 427/161 |
| 5,207,871 | A | | 5/1993 | Murphy et al. | 162/164.7 |
| 5,275,870 | A | | 1/1994 | Halope et al. | 428/199 |
| 5,336,743 | A | * | 8/1994 | Takaoka et al. | 526/292.4 |
| 5,344,192 | A | | 9/1994 | Phillips | 283/91 |
| 5,416,126 | A | | 5/1995 | Murphy et al. | 522/33 |
| 5,418,205 | A | | 5/1995 | Mehta et al. | 503/206 |
| 5,486,928 | A | | 1/1996 | Doublet et al. | 358/299 |
| 5,536,468 | A | | 7/1996 | Leese | 264/446 |
| 5,663,264 | A | | 9/1997 | Kawai et al. | 526/320 |
| 5,827,584 | A | * | 10/1998 | Akao et al. | 428/35.7 |
| 6,103,355 | A | * | 8/2000 | Mehta | 428/211 |

* cited by examiner

MULTI-FUNCTIONAL TRANSPARENT SECURE MARKS

CROSS REFERENCE TO RELATED APPLICATIONS

The present application is related to the following U.S. patent applications the disclosures of which are incorporated herein by reference: Ser. No. 09/104,573, filed Jun. 25, 1998 now U.S. Pat. No. 4,103,355; Ser. No. 09/104,589, filed Jun. 25, 1998 now U.S. Pat. No. 6,143,120.

BACKGROUND OF THE INVENTION

The present invention relates to the formation of chemical watermarks on a cellulosic paper substrate and, more particularly, to a multi-functional chemical watermark that is particularly well suited for security documents. Conventional watermarking is a process whereby a paper sheet is marked with specific permanent indicia. The indicia are formed in the paper web during the papermaking process by creating a localized orientation of the paper fiber in a predetermined pattern. The localized orientation creates a faint opacity difference within the body of the paper sheet such that, upon close inspection, the indicia may be viewed in the paper sheet. The economics of conventional watermarking is such that it is only cost-effective to create conventional watermarked paper in large batches.

A number of alternative chemical watermarking procedures have been developed as an alternative to conventional watermarking. Unfortunately, these alternative chemical watermarking procedures create watermarks that fall short of the high resolution standard of the conventional watermark. Further, many of the alternative chemical watermarks are subject to excessive degradation.

Accordingly, there is a need for an alternative watermarking scheme that rivals that of the conventional high resolution graphical watermarking scheme.

BRIEF SUMMARY OF THE INVENTION

This need is met by the present invention wherein a cellulosic sheet suitable for use as a security document is provided including a multi-functional transparent secure mark formed therein. In accordance with one embodiment of the present invention the secure mark comprises a transparentized portion of the substrate. The cellulosic substrate defines first and second major faces. The transparentized portion comprises a transparentizing composition applied to the cellulosic substrate in a predetermined pattern so as to define a graphical image having a relative transparency selected so as to define an area of increased transparency in the substrate. The transparentizing composition comprises a transparentizing agent and a security agent.

The security agent may comprise a photochromic agent, a thermochromic agent, a fluorescent agent, a coloring agent, a UV ink, a fragrance, or combinations thereof. The transparentizing composition may comprise a radiation-curable composition, a composition selected so as to cure upon contact with the cellulosic substrate, or another type of curable composition.

In accordance with another embodiment of the present invention, a cellulosic substrate is provided having at least one transparentized portion formed therein. The transparentized portion comprises a transparentizing composition applied to the cellulosic substrate in a predetermined pattern so as to define a graphical image having a relative transparency selected so as to define an area of increased transparency in the substrate. The transparentizing composition comprises a transparentizing agent. The transparentized portion includes a printed portion. Printed matter defining the printed portion is covered by the transparentizing composition. The printed portion may be positioned in a reduced-thickness portion of the substrate. The printed matter may comprise an amount field of a negotiable document or some other secure data field.

The cellulosic substrate may define a textured portion and the graphical image may be further defined by the textured portion. The textured portion and the transparentized portion may lie in common areas of the cellulosic substrate. The textured portion and the transparentized portion may define substantially identical boundaries and may be positioned in substantial alignment on the cellulosic substrate. The textured portion may defines a variable thickness profile across which is applied the transparentizing composition such that the area of increased transparency defines a varying transparency.

In accordance with yet another embodiment of the present invention, a cellulosic substrate is provided having at least one transparentized portion formed therein. The transparentized portion comprises a transparentizing composition applied to the cellulosic substrate in a predetermined pattern so as to define a graphical image having a relative transparency selected so as to define an area of increased transparency in the substrate. The transparentizing composition comprises at least one compound selected from compounds of the formula:

(I)

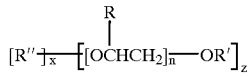

wherein

R" is any mono- or polyfunctional organic radical;

R is H or $CH_3$;

R' is H or —C(O)C(R)=$CH_2$, with the proviso that —C(O)C(R)=$CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and wherein if any of R, R', or R" are greater than one, their identities and the number of each may be the same or different;

or (II)

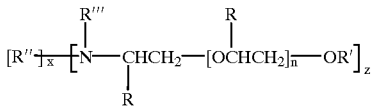

wherein

R" is any mono- or polyfunctional organic radical;

R is H or $CH_3$;

R' is H or —C(O)C(R)=$CH_2$, with the proviso that —C(O)C(R)=$CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and

R''' is H or a group of the formula

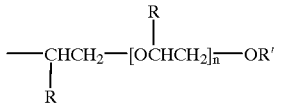

wherein

R, R', and n are as defined as above, wherein if any of R, R', R'' or R''' are greater than one, their identities and the number of each may be the same or different.

In accordance with yet another embodiment of the present invention, a cellulosic substrate is provided having at least one transparentized portion formed therein. The transparentized portion comprises a transparentizing composition applied to the cellulosic substrate in a predetermined pattern so as to define a graphical image having a relative transparency selected so as to define an area of increased transparency in the substrate. The transparentizing composition comprises:

i) a cationic catalyzable constituent selected from a vinyl ether, 2) a polyepoxide, 3) a mixture of vinyl ethers, 4) a mixture of polyepoxides, or 5) a mixture of at least one of a vinyl ether and at least one of a polyepoxide;

ii) a free radical catalyzable constituent selected from at least one compound of the Formula:

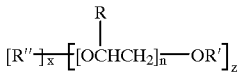

wherein,

R'' is any mono- or polyfunctional organic radical;

R is H or $CH_3$;

R' is H or —C(O)C(R)═$CH_2$, with the proviso that —C(O)C(R)═$CH_2$ occurs at least once;

x is an integer 0–4 and indicates the number of functional groups on R'' which are reactive with ethylene or propylene oxide;

z is an integer 1–4 and may vary independently of x and n;

n is an integer 0–20 and is independent of x and z; and wherein if any of R, R', or R'' are greater than one, their identities and the number of each may be the same or different; and iii) a catalyst constituent selected from 1) a free radical catalyst, 2) a mixture of free radical catalysts, 3) a living cationic catalyst, 4) a mixture of living cationic catalysts, or 5) mixtures of at least one of a free radical catalyst and at least one of a living cationic catalyst.

In accordance with yet another embodiment of the present invention, a cellulosic substrate is provided having at least one transparentized portion formed therein. The transparentized portion comprises a transparentizing composition applied to the cellulosic substrate in a predetermined pattern so as to define a graphical image having a relative transparency selected so as to define an area of increased transparency in the substrate. The transparentizing composition comprises at least one monomer selected from the group consisting of acrylic esters of polyhydric alcohols, methacrylic esters of polyhydric alcohols, and vinyl esters.

In accordance with yet another embodiment of the present invention, a cellulosic substrate is provided having at least one transparentized portion formed therein. The transparentized portion comprises a transparentizing composition applied to the cellulosic substrate in a predetermined pattern so as to define a graphical image having a relative transparency selected so as to define an area of increased transparency in the substrate. The transparentizing composition comprises a polymer consisting of aliphatic monomers selected from the group consisting of acrylic esters of polyhydric alcohols, methacrylic esters of polyhydric alcohols, and vinyl esters.

Accordingly, it is an object of the present invention to enhance document security by applying images that simulate high resolution graphical watermarks but provide enhanced security at a relatively lower cost than conventional watermarks. Further, it is an object of the present invention to realize improved economies by (i) enabling the production of documents including watermark type security images on bond paper stock as opposed to premium paper stock and (ii) enabling economical customization of watermark type security images. Further, it is an object of the present invention to provide documents including a glossy or plasticized security image. Also, it is an object of the present invention to provide documents including a security image that may be conveniently enhanced in a variety of ways or that may be produced to form a tactile feel. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
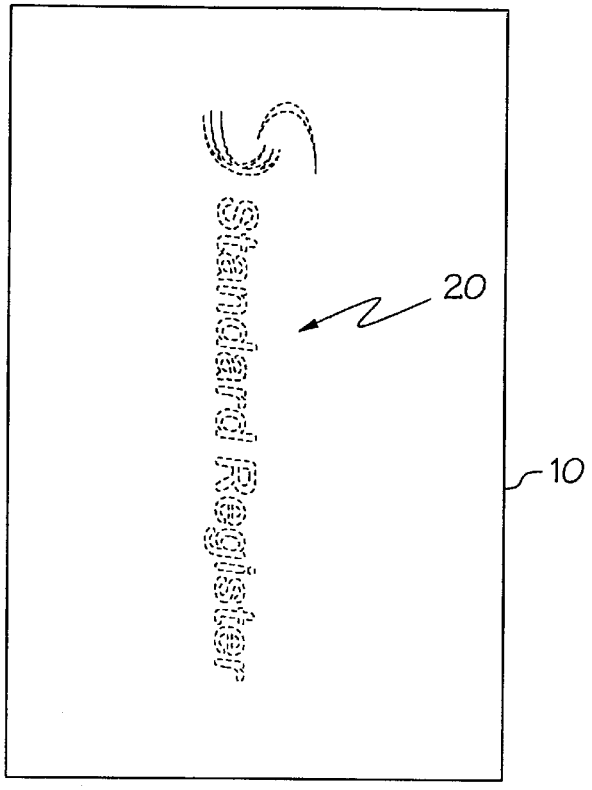
FIG. 1 is a schematic illustration of a cellulosic substrate including a secure mark according to the present invention.
Figure 2:
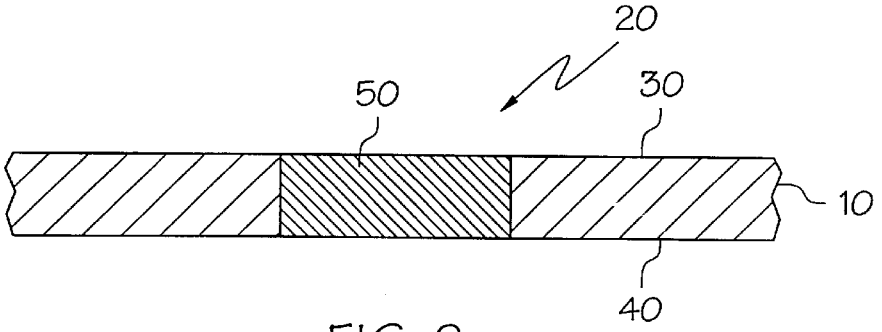
FIG. 2 is a schematic illustration, in cross section, of a cellulosic substrate including a portion of a secure mark according to the present invention.

Referring initially to FIGS. 1 and 2, a cellulosic sheet or substrate 10 including a multi-functional transparent secure mark 20 is illustrated. The cellulosic substrate 10 defines first and second major faces 30, 40 and the transparentized portion defining the transparent secure mark 20 comprises a transparentizing composition 50 applied to the substrate 10 so as to define a graphical image having a relative transparency selected so as to define an area of increased transparency in the substrate 10 and resemble a graphical watermark. For the purposes of defining and describing the present invention it is noted that a graphical watermark comprises an area of relatively elevated transparency defining a graphical design or pattern in the form of a series of characters, a distinctive mark, a logo, a company name, and the like. It should be appreciated that a basic substantially rectangular transparent area, i.e., a transparent window, does not fall within the definition of a graphical watermark. Rather, according to the present invention, the graphical design or pattern defined by the area of increased transparency and the degree of increased transparency are selected to resemble a graphical watermark.

As is illustrated in FIG. 2, the transparentizing composition 50 is absorbed into the substrate 10. The transparentizing composition 50 is press printed on one of the major faces 30, 40 to define precisely the bounds of the secure mark 20. In certain embodiments, the transparentizing composition 50 is printed simultaneously in corresponding areas on both of the major faces 30, 40 to provide faster penetration of the transparentizing material into the substrate 10. The press printing of the transparentizing composition 50 is accomplished by utilizing perfecting cylinders or other suitable printing equipment. The preferred method of printing the transparentizing composition is via flexography. Other methods, such as gravure, letterpress, or lithography may also be used.

Preferably, the transparentizing composition comprises a radiation-curable composition but may also comprise a composition that cures upon contact with a cellulosic substrate or that cures by other means. Among the commonly known means are thermal cure and two component reactive systems that cross-link on contact. A feasible way to utilize a two-component system would be to apply one component to each of the opposite major surfaces 30, 40 with a perfecting press.

Figure 3:
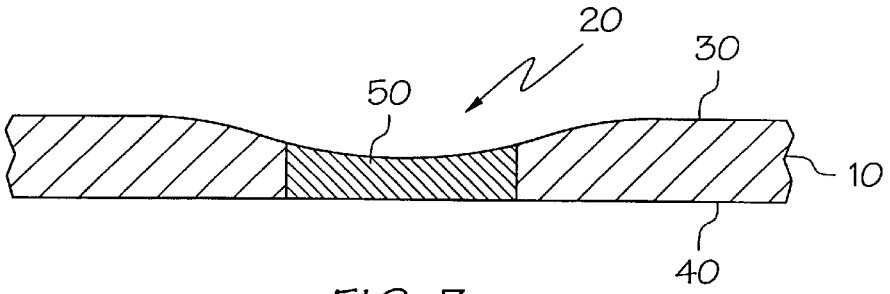
FIG. 3 is a schematic illustration, in cross section, of a cellulosic substrate including a reduced thickness portion and a portion of a secure mark according to the present invention.

In the embodiment of the present invention illustrated in FIG. 3, the thickness of the cellulosic substrate 10 is reduced in the area in which the transparentizing composition 50 is to be printed. In this manner, it is possible to ensure that the thickness of the cellulosic substrate 10 in the area in which the transparentizing composition 50 is absorbed does not exceed the thickness of the remainder of the substrate 10. Otherwise, the increased thickness may create problems in stacking, sorting, or processing sheets including the secure marks 20 according to the present invention.

Substrate thinning may be accomplished by compressing, such as by calendaring the predetermined portion to a predetermined thickness. Preferably, such predetermined thickness ranges from about 0.0005 inches to about 0.002 inches (i.e., about $1.27\times10^{-3}$ cm to about $5.08\times10^{-3}$ cm) following the compression of the predetermined portion. The preferred technique for compressing the substrate 10 is by calendaring the substrate 10 using calendaring equipment. In this manner, the area in which the secure mark 20 is formed will be thinner, and have a higher density, than the remainder of substrate 10. Compression in selected area may be accomplished by a pair of rotating cylinders, one of which has raised areas on its surface corresponding to areas to be compressed. Alternatively, the predetermined portion can be made thinner by mechanically grinding the portion. Preferably, the predetermined portion has a thickness ranging from about 0.0005 inches to about 0.002 inches (i.e., about $1.27\times10^{-3}$ cm to about $5.08\times10^{-3}$ cm) following the grinding operation.

Although FIG. 3 shows the reduction in thickness as having been performed on the upper or first face 30 of the cellulosic substrate 10, it can also be performed to the lower or second face 40, or on both faces. In addition, although FIG. 3 shows a reduction of the thickness of the substrate 10 wherein there is a gradual sloping, one of ordinary skill in the art will readily realize that such reduction of thickness may also be done such that there is a more abrupt sloping.

Figure 4:
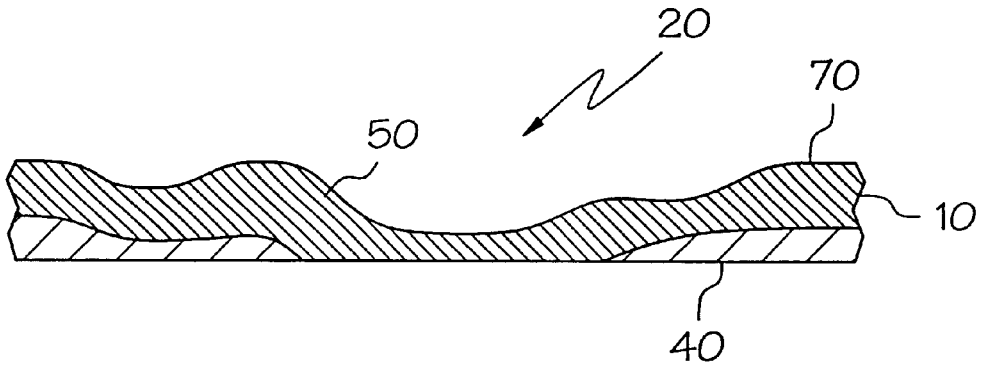
FIG. 4 is a schematic illustration, in cross section, of a variable thickness cellulosic substrate including a portion of secure mark according to the present invention.

Referring now to FIG. 4, a further embodiment of the present invention is illustrated. In the illustrated embodiment, the cellulosic substrate 10 defines a textured portion 70 and the graphical image defined by the transparentizing composition 50 is further defined by the textured portion 70. For example, the textured portion 70 may comprise an embossed or debossed graphical image similar to a high definition watermark. Preferably, the textured portion 70 and the transparentized portion defining the transparent secure mark 20 define substantially identical boundaries and are positioned in substantial alignment on the cellulosic substrate 10. Further, as is illustrated in FIG. 4, the textured portion 70 defines a variable thickness profile across which the transparentizing composition 50 is applied. In this manner, the area of increased transparency defines a varying transparency profile across the substrate 10.

Figure 5:
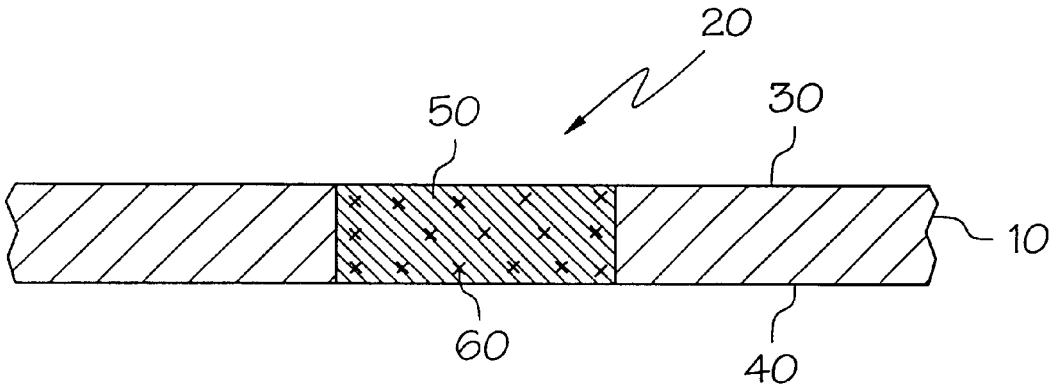
FIG. 5 is a schematic illustration, in cross section, of a cellulosic substrate including a portion of an enhanced secure mark according to the present invention.

Referring now to FIG. 5, to enhance the security of the secure sheet of the present invention, the transparentizing composition 50 comprises a security agent 60 in addition to the transparentizing agent. For the purposes of describing and defining the present invention, it is noted that a security agent comprises any additive that enhances the security of the transparent secure mark 20 of the present invention. For example, the transparentizing composition 50 may comprise a security agent 60 in the form of a photochromic agent, a thermochromic agent, a fluorescent agent, a coloring agent, a UV ink, a fragrance, or combinations thereof. In the case of the fluorescent agent and the UV ink, these materials are incorporated into the transparentizing composition to enhance the visibility of the secure mark 20 upon exposure to UV light. Preferably, the fluorescent material is soluble in the transparentizing composition 50. The resulting dual function secure mark provides enhanced confidence that a secure document including the dual function mark is authentic. Even greater confidence in authenticity is provided if the fluorescent agent is one that has been chosen to function in a system designed for the detection of the spectral emissions of a predetermined fluorescent agent.

Similarly, an enhanced security mark is provided where a photochromic material is combined with the transparentizing composition 50. The photochromic material may be soluble in the transparentizing composition 50 or it may be suspended and dispersed as insoluble pigment particles or as micro capsules containing a solvent solution. According to this aspect of the present invention, authenticity of a secure document bearing the security mark 20 is indicated if the security mark changes color when exposed to light of the proper wavelength and intensity.

A multi-functional mark may also be provided by including the thermochromic agent with transparentizing composition 50. In this case, the security mark 20 is not only visible by transmitted visible light, but also changes color when heated or cooled to the proper activating temperature. Temperature variations may be introduced with an external source or via frictional rubbing.

According to an additional aspect of the present invention, the security of a document including the secure mark according to the present invention may be enhanced by embedding, encasing, or covering specific printed matter with the transparentizing composition. The printed matter may comprise specific security printing, e.g., a security pattern, a logo, etc. Further the printed matter may comprise an amount field of a negotiable document or another type of secure data field. The resulting secure document would be very difficult to alter or counterfeit. It may be necessary to calender the area in which the printed matter is to be presented to ensure that the thickness of the substrate including the printed portion does not exceed the thickness of the remainder of the substrate.

The above described alternate embodiments of secure marks 20 contain combinations of in a single composition printed as a single mark with multiple functions. However, it is contemplated that distinct printable compositions may be formulated with distinct functionality and printed as separate images on a single document. Thus, the document may be checked for authenticity by examining each image separately.

For the purposes of describing and defining the present invention, a transparentized secure mark comprises a localized modification of the structure and opacity of a cellulosic substrate so that a pattern or design can be seen when the sheet is held to the light or otherwise examined. Further, it should be understood that, according to the present invention, the degree of transparency embodied in the transparent secure mark 20 of the present invention may be varied to suit the needs of those practicing the present invention. Further, it is contemplated by the present invention that the multi-functional secure marks of the present invention may be combined with other security features.

Regarding the transparentizing composition, it is noted that the composition is described herein in terms of three general formulations. Each formulation is described in detail below. It is contemplated by the present invention, however, that although the below-described compositions embody specific advantages over conventional compositions, any suitable transparentizing composition may be utilized to form the above described multi-functional secure marks of the present invention.

Transparentizing Composition According to One Embodiment of the Present Invention In this embodiment of the present invention, a solventless transparentizing material is provided which penetrates a cellulosic substrate very quickly and completely, and forms a cured polymeric transparentized portion possessing advantageous physical and chemical properties and exhibiting a high degree of transparency. In this manner, a very high-quality transparentized portion can be formed on cellulosic substrates in a fast, continuous, in-line process, without the need for recovering a solvent. Further, this embodiment of the present invention provides a liquid polymerizable transparentizing composition which exhibits good toner adhesion properties and is cured by radiation rather than by thermal polymerization.

The radiation curable transparentizing composition of this embodiment of the present invention comprises at least one monomer selected from the group consisting of acrylate or methacrylate esters of polyhydroxy polyethers made from polyhydric alcohols (polyols) starting materials (compounds of Formula I) and/or acrylate or methacrylate esters of polyhydroxy polyethers made from primary or secondary amine starting materials (compounds of Formula II).

A novel feature of the invention is the use in transparentizing formulations of acrylate and/or methacrylate esters of hydroxy polyethers made by reaction of ethylene and/or propylene oxide with organic compounds having one or more reactive sites, such reactive sites comprising hydroxyl and primary or secondary amine groups. These acrylate/methacrylate esters may be represented by either of the following formulas (I and II):

I

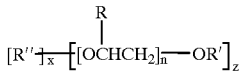

wherein

R" is any mono- or polyfunctional organic radical;

R is H or $CH_3$;

R' is H or —C(O)C(R)=$CH_2$ with the proviso that —C(O)C(R)=$CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and wherein if any of R, R', or R" are greater than one, their identities and the number of each may be the same or different;

and

II

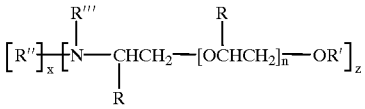

wherein

R" is any mono- or polyfunctional organic radical;

R is H or $CH_3$;

R' is H or —C(O)C(R)=$CH_2$ with the proviso that —C(O)C(R)=$CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and

R " is H or a group of the formula

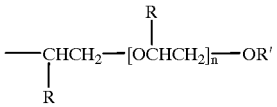

wherein

R, R', and n are as defined as above, wherein if any of R, R', R" or R'" are greater than one, their identities and the number of each may be the same or different.

These agents may be used alone, that is, as individual compounds selected from either Formula I or Formula II. Alternatively, these agents may be used as mixtures of compounds of Formula I, mixtures of compounds of Formula II, or as mixtures of compounds of Formula I and compounds of Formula II.

The compounds of Formula I and Formula II are an improvement over known transparentizing agents in that incorporation of the repeating ethylene oxide units renders the them hydrophilic (water-loving) and polar. Due to the increased polarity of these compounds, they exhibit enhanced toner adhesion properties, thus allowing more transparentizing material to be loaded onto the cellulosic substrate. The ability to load more transparentizing material onto the paper substrate is highly desirable in that there is a direct relationship between the amount of transparentizing material loaded on the paper and the degree of transparency achieved in the final product. In addition, radiation curing of the transparentizing material is preferred in that it is faster and more reliable than other forms of curing such as, for example, heat curing. These features thus permit continuous, in-line transparentization. Another advantage of the above-recited transparentizing material is that penetration is achieved without the need for solvents. Thus, the transparentizing material is applied can be a 100% solid composition, thus eliminating the need for evaporation and recovery of solvent from the substrate.

In the preferred embodiment, the transparentizing material further includes a small amount of water. Generally, the amount of water used in this embodiment constitutes between about 1% to about 15% of the total transparentizing formulation. Unlike most transparentizing agents which are non-polar and therefore not soluble in water, the compounds of Formula I and Formula II form miscible mixtures with small amounts of water. The resulting miscible formulation exhibits increased wetting capabilities and, resulting in an increased speed of penetration into the paper substrate and allowing for faster line-speeds. This increased speed of penetration is sufficiently high that faster line-speeds are obtained even taking into account the time necessary to remove the water prior to radiation curing.

A further advantage of the use of the above-recited polymerizable transparentizing compositions is that the transparentized portion produced by the coating is a high quality one. Physically, the transparentized portion is strong and flexible and is highly receptive to inks and/or toner.

Chemically, the transparentized portion of this embodiment of the present invention meets U.S. Postal Service specifications for reflectance and PCR. This is believed possible due to the fact that the transparentizing material penetrates the substrate substantially completely. Additionally, the resulting transparentized portion has sufficient resistance to migration and/or volatilization of the radiation cured material that it does not lose its transparency over time. While not wishing to be bound by any specific theory, this advantage is believed due to the fact that the transparentizing material is applied is 100% solids and the fact that the transparentizing material can be radiation cured almost immediately after it has been applied to the substrate since it penetrates the substrate so quickly.

Although the radiation curable transparentizing materials of the present embodiment penetrate the fastest when used without oligomers or prepolymers, there may be occasions when the need for specific physical and/or chemical properties in the transparentized portion outweigh the need for high speed penetration. In such circumstances, oligomers and/or prepolymers may be included in the coating. For example, it may be desirable to include one or more prepolymers in the transparentizing material if, due to the nature of the cellulosic substrate, for instance, it were necessary to adjust the refractive index of the transparentizing material in order to ensure that the cured transparentizing material has a refractive index close to that of the cellulosic substrate. The preferred prepolymers for this purpose are selected from the group consisting of styrene-maleic anhydride prepolymer, styrene-acrylic acid prepolymer, and styrene-methacrylic acid prepolymer. Similarly, it may also be necessary in certain situations to have a transparentized portion with extra flexibility. In such situations, an oligomer may be included in the transparentizing material. The preferred oligomers are styrene-acrylic acid oligomers and urethane acrylate oligomers. Whether or not a prepolymer and/or oligomer is included in the transparentizing material, however, it is preferable that the transparentizing material have a refractive index of about 1.5 after the transparentizing material has been cured. Further, the transparentized portion of the substrate preferably has a thickness in the range of from about 0.0005 to about 0.002 inches (i.e., about $1.27\times10^{-3}$ cm to about $5.08\times10^{-3}$ cm).

In addition, the radiation curable transparentizing material may include other monomers, such as vinyl ethers and/or acrylate or methacrylate esters of polyhydric alcohols which contain 4 or more acrylate or methacrylate functionalities. Vinyl ethers may be added to the transparentizing material to eliminate odor and to lower the viscosity of the formulation, thereby allowing even faster penetration into the cellulosic substrate. Acrylate or methacrylate esters of polyhydric alcohols which contain 4 or more acrylate or methacrylate functionalities may be added to the transparentizing material to increase the cross-linking density, to lower the viscosity, and to generally increase the rate of curing of the transparentizing material.

As mentioned, the speed at which the above-recited transparentizing material penetrates allows transparentizing to occur in a continuous, in-line process. Such a process may be a continuous flexographic printing process, gravure, or roll-metering process, with flexographic being preferred, in which the step of applying the transparentizing material to the predetermined portion occurs in the continuous printing process. The polymerizable transparentizing compositions of this embodiment of the present invention have a viscosity which makes them suitable as "inks" to be applied by printing techniques. The transparentizing material is then cured immediately thereafter as a subsequent step in the continuous process. Preferably, those steps occur at a speed of about 75 to about 1000 linear feet (i.e., about 22.86 linear meters to about 304.8 linear meters) of substrate per minute.

Accordingly, it is a feature of this embodiment of the present invention to provide a transparentized cellulosic substrate by the application of a transparentizing material which contains transparentizing agents which are hydrophilic (water-loving) and polar and therefore provide enhanced toner adhesion properties and fast penetration rates. In addition, these transparentizing agents do not form emulsions upon the addition of small amounts of water, and the transparentizing agents which contain small amounts of water exhibit even faster penetration rates. Further, these transparentizing materials may be applied without the need for solvents. Moreover, this embodiment of the present invention also provides a solventless transparentizing material which penetrates the substrate very quickly and completely, and forms a cured polymeric transparentized portion which not only possesses the aforementioned physical and chemical properties, but also exhibits an improved degree of transparency. In this manner, a very high-quality transparentized portion can be formed on cellulosic substrates in a fast, continuous, in-line process, without the need for recovering a solvent. Further this embodiment of the present invention provides liquid polymerizable transparentizing compositions which exhibit good toner adhesion properties and are cured by radiation rather than by thermal polymerization. These features thus permit continuous, in-line transparentization.

The transparentizing agent of this embodiment of the present invention permits formation of a transparentized portion wherein no thinning of the area is required to result in a transparentized portion that does not increase the thickness of substrate. This may be accomplished by either applying localized heat to the substrate, e.g., about 50° C. to about 100° C., prior to the application of the transparentizing material, heating the transparentizing material to a temperature of about 30° C. to about 50° C. prior to application, or both.

The transparentizing agents of this embodiment of the present invention typically constitute 75–95% by weight and preferably 80–90% by weight of the final transparentizing material. These agents are acrylate and/or methacrylate esters of hydroxy polyethers made by reaction of ethylene and/or propylene oxide with organic compounds having one or more reactive sites, such reactive sites comprising hydroxyl and primary or secondary amine groups, as described above.

As used herein, the term "any organic radical" refers to any organic radical which can be attached to a hydroxyl, primary amine or secondary amine. Typical examples include mono- or multi-functional aromatic or aliphatic functionalities, wherein the aliphatic functionalities may be unsaturated, saturated, straight, branched, or cyclic in configuration.

Compounds of Formula I and II are commercially available or may be prepared by procedures and techniques well known to one of ordinary skill in the art. For Example, compounds of Formula I may be prepared essentially as shown in Scheme A wherein all substituents are as previously defined unless otherwise specified.

SCHEME A

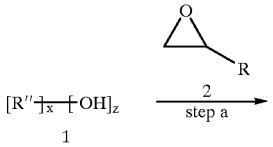

-continued

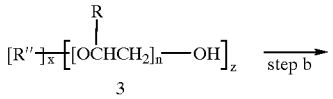

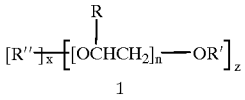

Compounds of Formula I may be prepared by techniques and procedures well known to one of ordinary skill in the art. For example, in Scheme A, step a, a polyhydric alcohol of formula 1 is reacted with an excess of an oxide of formula 2 to give a polyhydroxy polyether of formula 3. In step b, at least one of the hydroxy functionalities of the polyhydroxy polyether of formula 3 is esterified with acryloyl chloride or methacryloyl chloride to give the compounds of Formula I. Although depicted in Scheme A as complete esterification of all hydroxy functionalities of compounds of formula 3, it is understood that by varying the proportion of reagents, reactions times, and reaction temperatures, that some hydroxy functionalities of the compounds of formula 3 will not be esterified. Representative examples of compounds of Formula I are polypropylene glycol monoacrylate, ethoxylated trimethyolpropane triacrylate, and propoxylated neopentyl glycol diacrylate.

Compounds of Formula II may be prepared essentially as in Scheme B wherein all substituents are as previously defined unless otherwise specified.

SCHEME B

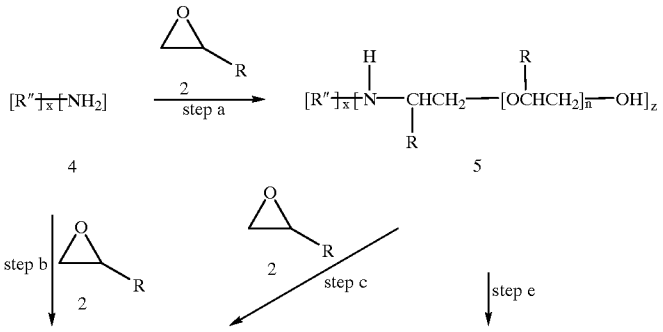

-continued

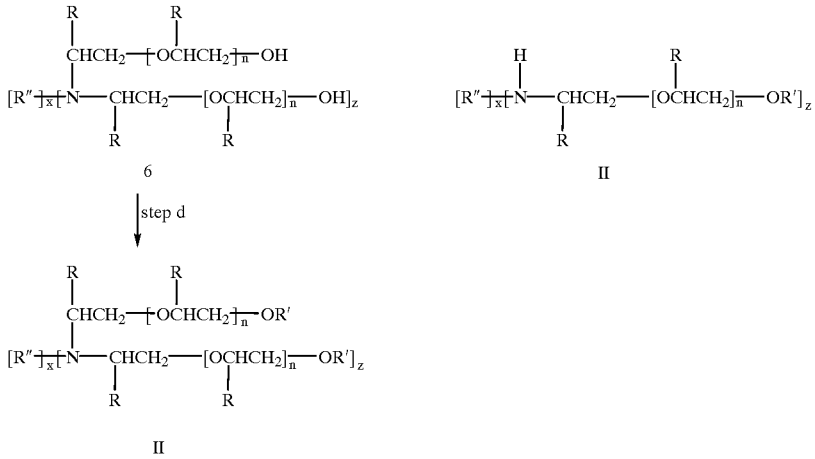

The compounds of Formula II may also be prepared by techniques and procedures well known to one of ordinary skill in the art. For example, in Scheme B, step a and step b, a polyhydric amine of formula 4 is reacted with an excess of an oxide of formula 2. Depending upon the proportion of reagents, reaction times, and reaction temperatures, the reaction of step a may result either in the formation of the secondary polyamine polyether of formula 5 as shown in step a or the tertiary polyamine polyether of formula 6 as shown in step b. Alternatively, the tertiary polyamine polyether of formula 6 may be formed from the reaction of the secondary polyamine polyether of formula 5 with excess oxide of formula 2. In step d, at least one hydroxy functionality of the tertiary polyamine polyether of formula 6 is esterified with acryloyl chloride or methacryloyl chloride to give the tertiary polyamine compounds of Formula II. Similarly, in step e, at least one of the hydroxy functionalities of the secondary polyamine polyether of formula 5 is esterified with acryloyl chloride or methacryloyl chloride to give the secondary polyamine compounds of Formula II. Although depicted in Scheme B as complete esterification of all hydroxy functionalities of compounds of formula 5 and 6, it is understood that by varying the proportion of reagents, reactions times and reaction temperatures, that some hydroxy functionalities of the compounds of formula 5 and 6 will not be esterified.

In Scheme A and B, all starting materials and reagents are commercially available or readily available to one of ordinary skill in the art.

When one or more of the monomers of Formula I and/or Formula II, without oligomers or prepolymers, are included in a radiation curable transparentization material, the liquid coating penetrates a cellulosic substrate quite rapidly and can be applied as a "100% solids" and still achieve a rapid rate of penetration. "100% solids" means a liquid material which can be converted 100% to a solid upon curing (i.e., crosslinking or polymerization). Thus, it contains no residual volatiles or solvents. However, if even faster penetration is desired, a polar organic solvent can be added to the coating to lower the viscosity thereof. Preferred solvents are solvents which are polar and miscible with water and include methanol, ethanol, isopropanol, acetone and the like.

In the preferred embodiment, the radiation curable transparentizing material includes small amounts of water. Typically, in this embodiment, water constitutes from about 1–15% and preferably from about 5–10% by weight of the final composition. As stated previously, unlike most transparentizing agents which are non-polar and therefore not soluble in water, the transparentizing agents of Formula I and Formula II form miscible mixtures with small amounts of water. Prior to exposure to radiation, the water is removed by evaporation with heat at a temperature sufficient to remove water. As one of ordinary skill in the art would realize, the faster the line speed, the higher the temperature required to remove the water. Typically, temperatures at or above 120° C. are utilized with higher line speeds, such as those at or above 500 linear feet per minute.

Preferably, the polymerizable transparentizing composition is cured by exposure to radiation-either electron beam, visible, or ultraviolet radiation. Curing causes the polymerizable constituents of the transparentizing composition to polymerize, thus making a permanently transparentized portion. Once the transparentizing material is cured, it is a solid and will not migrate or volatilize. Advantageously, the rapidity with which the present transparentizing material penetrates the substrate allows curing thereof almost immediately following its application to the substrate, thus providing substantially no opportunity for the material to migrate or volatilize beyond the area to which it has been applied.

If electron beam curing is employed, no photocatalyst is needed. However, if curing it carried out by exposing the transparentizing material to ultraviolet radiation, a photocatalyst needs to be included. Preferably, the photocatalyst is of the free radical type. A wide variety of such photocatalysts can be used provided they do not deleteriously affect the desired physical and chemical properties of the resultant transparentized portion. Examples of useful free radical photocatalysts include an alkyl benzoin ether, such as benzoin ether benzophenone, a benzophenone with an amine such as methyl diethanolaminedimethylquinoxiline 4,4' bis (dimethylamine bezophenone), and acetophenones such as 2,2 diethoxyacetophenone and t-butyl trichloroacetophenone. A preferred class of useful free radical photocatalysts are haloalkyl substituted aryl ketone compounds. All such photocatalysts, useful in the practice of this invention, are either readily available commercially or are easily prepared using known techniques. Typically, when a photocatalyst is used, it will constitute approximately 1–15% by weight of the composition.

The speed at which the transparentizing material of this embodiment of the present invention penetrates a substrate allows transparentizing to occur in a continuous, in-line process. Such a process can include any conventional printing method such as flexographic, gravure, or screen. A continuous transparentization process can be set up in which the transparentizing material is first applied to an area in a flexographic printing press and then cured immediately thereafter by electron beam, visible, or ultraviolet radiation.

In the case of a flexographic printing press in combination with ultraviolet curing, for example, an acceptable rate of transparentization (i.e., applying the transparentizing material to a substrate, evaporating water if necessary, and curing it) is from about 75 to about 150 linear feet (i.e., about 22.9 meters to about 45.72 meters) of substrate per minute. Obviously faster production speeds are usually preferred. One expedient for increasing production speed is to mildly heat the substrate and/or transparentizing material (50° C.–100° C.) to effectively reduce viscosity and increase the penetration rate. The preferred viscosity of the coating at 25° C. is from about 30 to about 100 centipoise and more preferably from about 30 to about 70 centipoise. The preferred wavelength of the ultraviolet curing light is from about 200 to about 400 nanometers, and the preferred ultraviolet curing light capacity is from about 300 to about 600 watts per inch of substrate width.

The transparentizing material can be applied to one or both sides of a substrate. It is preferred, however, that it be applied simultaneously to both sides of an area. Such simultaneous application provides even faster penetration of the transparentizing material into the substrate.

Advantageously, the use of one or more of the above-recited compounds of Formula I and Formula II, without oligomers or prepolymers, results in a transparentizing material which not only penetrates a substrate quickly, but also produces a transparentized portion which meets all of the desired physical and chemical properties. Physically, transparentized portion is strong, flexible and durable such that it will maintain its transparency when subjected to rough handling. In addition, transparentized portion is highly receptive to inks and/or toners.

Chemically, the transparentized portion has sufficient resistance to ultraviolet radiation that it does not lose its transparency over time. The transparentized portion meets U.S. Postal Service specifications for reflectance and PCR. This is believed possible due to the fact that the above-recited monomers achieve substantially complete penetration of the substrate. Additionally, the transparentized portion has sufficient resistance to migration and/or volatilization of the radiation cured transparentizing material that it does not lose its transparency over time. Due to the rapid penetration of the transparentizing material into the substrate, the transparentizing material can be cured almost immediately after it has been applied to an area. Moreover, although compatible with polar organic solvents, the transparentizing material of the present embodiment does not require the use of organic solvents. Therefore, it is less volatile after curing than one containing an organic solvent, thus further reducing the tendency to migrate or volatilize.

It is preferred that the transparentizing material, once cured, have a refractive index as close as possible to that of substrate. This will ensure that the transparentized portion will be sufficiently transparent. Most cellulosic substrates have a refractive index of around 1.5. Thus, the preferred refractive index of the cured coating is similarly around 1.5.

However, some cellulosic substrates have a refractive index which is greater than 1.5. With such substrates, it may be desirable to include one or more prepolymers with the transparentizing material in order to increase the refractive index of the cured transparentizing material to substantially match that of the substrate. Typically, 1.55 is the highest value that the refractive index of the cured transparentizing material will need to attain in this manner. The preferred prepolymers for this function include styrene-maleic anhydride, styrene-acrylic acid and, styrene-methacrylic acid. The most preferred prepolymer of this group is styrene-maleic anhydride.

It may also be desirable in certain situations to have a transparentized portion with extra flexibility. For this purpose, an oligomer may be included with the transparentizing material. The preferred oligomers in this instance are urethane acrylate oligomer and styrene-acrylic oligomer.

Further, an amine may be included with the transparentizing material in order to reduce the curing time thereof. The preferred amine for this purpose is triethanol amine. Alternatively, compounds of Formula II may also be used for this purpose. Typically, when an amine is included in the transparentizing material for this purpose, it will constitute approximately 1–7% by weight of the composition.

Still further, a vinyl ether may be included with the transparentizing material to decrease odor. The preferred vinyl ether for this function is vinyl pyrrolidone. When included, a vinyl ether typically will constitute about 5% by weight of the final transparentizing material. It should be noted however, that the use of vinyl ethers is not compatible with the embodiment which includes small amounts of water.

Still further, acrylate or methacrylate esters of polyhydric alcohols which contain 4 or more acrylate or methacrylate functionalities may be added to the transparentizing material to increase the cross-linking density, lower the viscosity, and to generally increase the rate of curing of the transparentizing material. The preferred acrylates or methacrylates esters for this purpose are pentaerythritol tetramethacrylate, dipentaerythritol pentacrylate, and dipentaerythritol deshydroxymethyl pentacrylate. When included, an acrylates or methacrylates esters of this type will typically will constitute from about 1–10% by weight of the final transparentizing material.

In order that the invention may be more readily understood, reference is made to the following examples, which are intended to be illustrative of the present embodiment of the invention but are not intended to be limiting in scope.

EXAMPLE 1

A radiation curable liquid transparentizing material was prepared in accordance with this embodiment of the present invention by blending the materials listed below. The liquid was then applied to a substrate by flexographic printing and cured by ultraviolet radiation at a wavelength of from about 200 to about 400 nanometers.

| | Percent by weight |
|---|---|
| Polypropylene glycol monoacrylate[1] | 60.5 |
| Water | 6.2 |
| Ethoxylated trimethyolpropanetriacrylate[2] | 22.8 |
| Triethanolamine | 2.9 |
| Photocatalyst[3] | 7.6% |

[1]SR-604 from Sartomer
[2]SR-415 from Sartomer
[3]Iracure 1173 from Ciba Geigy

EXAMPLE 2

A radiation curable transparentizing liquid was prepared as in Example 1 using the following materials:

| | Percent by weight |
|---|---|
| Polypropylene glycol monoacrylate[1] | 17.5 |
| Water | 6.2 |
| Ethoxylated trimethyolpropanetriacrylate[2] | 65.8 |
| Triethanolamine | 2.9 |
| Photocatalyst[3] | 7.6% |

[1]SR-604 from Sartomer
[2]SR-415 from Sartomer
[3]Iracure 1173 from Ciba Geigy

EXAMPLE 3

A radiation curable transparentizing liquid was prepared as in Example 1 using the following materials:

| | Percent by weight |
|---|---|
| Propoxylated Neopentyl glycol diacrylate[1] | 66.7 |
| Ethoxylated trimethyolpropanetriacrylate[2] | 20.5 |
| Dipentaerythritol pentacrylate[3] | 3.1 |
| Triethanolamine | 2.9 |
| Photocatalyst[4] | 6.8% |

[1]SR-9003 from Sartomer
[2]SR-415 from Sartomer
[3]SR-9041 from Sartomer
[4]Iracure 500 or 1173 from Ciba Geigy

EXAMPLE 4

A radiation curable transparentizing liquid was prepared as in Example 1 using the following materials:

| | Percent by weight |
|---|---|
| Propoxylated Neopentyl glycol diacrylate[1] | 66.7 |
| Ethoxylated trimethyolpropanetriacrylate[2] | 20.5 |
| Dipentaerythritol pentacrylate[3] | 3.1 |
| Photocatalyst[4] | 9.7 |

[1]SR-9003 from Sartomer
[2]SR-415 from Sartomer
[3]SR-9041 from Sartomer
[4]Iracure 500 or 1173 from Ciba Geigy

Transparentizing Composition According to Another Embodiment of the Present Invention In this embodiment of the present invention, a solventless transparentizing material is provided which penetrates a cellulosic substrate very quickly and completely, and forms a cured polymeric transparentized portion possessing advantageous physical and chemical properties and exhibiting a high degree of transparency. In this manner, a very high-quality transparentized portion can be formed on cellulosic substrates in a fast, continuous, in-line process, without the need for recovering a solvent. Further, this embodiment of the present invention provides a liquid polymerizable transparentizing compositions which exhibits good toner adhesion properties and is cured by radiation rather than by thermal polymerization and which cure both rapidly and completely. In addition, the liquid polymerizable transparentizing compositions of this embodiment of the present invention exhibit minimal odor and skin-irritating qualities.

The radiation curable transparentizing composition of this embodiment of the present invention comprises a free-radical catalyzable constituent; a cationic catalyzable constituent; and a catalyst. As used herein, the term "cationic catalyzable constituent" refers to a vinyl ether, a polyepoxide, a mixture of vinyl ethers, a mixture of polyepoxides, or a mixture of at least one of a vinyl ether and at least one of a polyepoxide. As used herein, the term "free radical catalyzable constituent" refers to compounds of the following formula or mixtures of compounds of the following formula:

$$[R''\underset{x}{]}\!\!-\!\!\underset{n}{[}OC\overset{R}{\overset{|}{H}}CH_2]\!\!-\!\!OR']_z$$

wherein

R" is any mono- or polyfunctional organic radical;

R is H or $CH_3$;

R' is H or —C(O)C(R)═$CH_2$, with the proviso that —C(O)C(R)═$CH_2$ occurs at least once;

x is an integer 0–4 and indicates the number of functional groups on R" which are reactive with ethylene or propylene oxide;

z is an integer 1–4 and may vary independently of x and n;

n is an integer 0–20 and is independent of x and z; and wherein if any of R, R', or R" are greater than one, their identities and the number of each may be the same or different. As used herein, the term "catalyst" refers to a photocatalyst selected from a free radical catalyst, a mixture of free radical catalysts, a living cationic catalyst, a mixture of living cationic catalysts, or mixtures of at least one of a free radical catalyst and at least one of a living cationic catalyst.

Thus, in one embodiment, there is provided a method of transparentizing a cellulosic substrate which comprises the steps of a) providing a cellulosic substrate; b) applying to at least one surface of the substrate a transparentizing composition comprising: 1) at least one of a polyepoxide; 2) and at least one of a compound or mixture of compounds of Formula I; and 3) at least one of a free radical catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a vinyl ether in admixture with at least one of a polyepoxide; 2) at least one of a compound of Formula I; and 3) at least one of a free radical catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a polyepoxide; 2) at least one of a compound of Formula I; and 3) at least one of a living cationic catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a vinyl ether; 2) at least one of a compound of Formula I; and 3) at least one of a living cationic catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a vinyl ether in admixture with at least one of a polyepoxide; 2) at least one of a compound of Formula I; and 3) at least one of a living cationic catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a polyepoxide; 2) at least one of a compound of Formula I; and 3) at least one of a free radical catalyst in admixture with at least one of a living cationic catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a vinyl ether; 2) at least one of a compound of Formula I; and 3) at least one of a free radical catalyst in admixture with at least one of a living cationic catalyst; and c) curing the transparentizing composition with radiation.

In another embodiment, there is provided a method of transparentizing a cellulosic substrate which comprises the steps of: a) providing a cellulosic substrate; b) applying to at least one surface of the substrate a transparentizing composition comprising: 1) at least one of a vinyl ether in admixture with at least one of a polyepoxide; 2) at least one of a compound of Formula I; and 3) at least one of a free radical catalyst in admixture with at least one of a living cationic catalyst; and c) curing the transparentizing composition with radiation.

An advantage of the use of the above-recited polymerizable transparentizing compositions is that the transparentized portion produced by the coating is a high quality one. Physically, the transparentized portion is strong and flexible and is highly receptive to inks and/or toner.

Chemically, the transparentized portion of this embodiment of the present invention meets U.S. Postal Service specifications for reflectance and PCR. This is believed possible due to the fact that the transparentizing material penetrates the substrate substantially completely. Additionally, the resulting transparentized portion has sufficient resistance to migration and/or volatilization of the radiation cured material that it does not lose its transparency over time. While not wishing to be bound by any specific theory, this advantage is believed due to the fact that the transparentizing material is applied is 100% solids and the fact that the transparentizing material can be radiation cured almost immediately after it has been applied to the substrate since it penetrates the substrate so quickly.

Although the radiation curable transparentizing materials of this embodiment of the present invention penetrate the fastest when used without oligomers or prepolymers, there may be occasions when the need for specific physical and/or chemical properties in the transparentized portion outweigh the need for high speed penetration. In such circumstances, oligomers and/or prepolymers may be included in the coating. For example, it may be desirable to include one or more prepolymers in the transparentizing material if, due to the nature of the cellulosic substrate, for instance, it were necessary to adjust the refractive index of the transparentizing material in order to ensure that the cured transparentizing material has a refractive index close to that of the cellulosic substrate. The preferred prepolymers for this purpose are selected from the group consisting of styrene-maleic anhydride prepolymer, styrene-acrylic acid prepolymer, and styrene-methacrylic acid prepolymer. Similarly, it may be necessary in certain situations to have a transparentized portion with extra flexibility. In such situations, an oligomer may be included in the transparentizing material. The preferred oligomers are styrene-acrylic acid oligomers or urethane acrylate oligomers. Whether or not a prepolymer and/or oligomer is included in the transparentizing material, however, it is preferable that the transparentizing material have a refractive index of about 1.5 after the transparentizing material has been cured. Further, the transparentized portion of the substrate preferably has a thickness in the range of from about 0.0005 to about 0.002 inches (i.e., about $1.27\times10^{-3}$ cm to about $5.08\times10^{-3}$ cm).

In addition to the foregoing, this embodiment of the present invention provides a method of transparentizing a predetermined portion or portions of a cellulosic substrate, preferably such that a smooth interface exists between the transparentized portion and the remainder of the substrate, and preferably such that the transparentized portion has a thickness which is no greater than the thickness of the remainder of the substrate. In some embodiments, the method comprises making a predetermined portion of the substrate thinner than the remainder of the substrate such that the predetermined portion is rendered substantially transparent, and applying a transparentizing material to the predetermined portion. In other embodiments, the method comprises heating the transparentizing material prior to application to the predetermined portion of the substrate, heating the predetermined portion of the substrate prior to application of the transparentizing material, or heating both the transparentizing material and the predetermined portion of the substrate prior to application of the transparentizing material.

As mentioned, the speed at which the above-recited transparentizing material penetrates allows transparentizing to occur in a continuous, in-line process. Such a process may be a continuous flexographic printing process, gravure, or roll-metering process, with flexographic being preferred, in which the step of applying the transparentizing material to the predetermined portion occurs in the continuous printing process. The polymerizable transparentizing compositions of this embodiment of the present invention have a viscosity which makes them suitable as "inks" to be applied by printing techniques. The transparentizing composition is then cured immediately thereafter as a subsequent step in the continuous process. Preferably, those steps occur at a speed of about 75 to about 1000 linear feet (i.e., about 22.86 linear meters to about 304.8 linear meters) of substrate per minute.

To provide even faster penetration of the transparentizing material into the substrate, the step of applying the transparentizing material to the predetermined portion can occur simultaneously to both the upper and lower surfaced of the predetermined portion. The transparentizing agent of this embodiment of the present invention permits formation of a transparentized portion wherein no thinning of the area is required to result in a transparentized portion that does not increase the thickness of substrate. This may be accomplished by either applying localized heat to the substrate, e.g., about 50° C. to about 100° C., prior to the application of the transparentizing material, heating the transparentizing material to a temperature of about 30° C. to about 50° C. prior to application, or both.

The radiation curable transparentizing composition of the present embodiment of this embodiment of the present invention comprises a free-radical catalyzable constituent; a cationic catalyzable constituent; and a catalyst, as described above. As is stated above, the free radical catalyzable constituents for use in this embodiment of the present invention may be represented by the following formula:

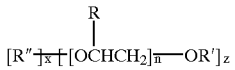

wherein

R" is any mono- or polyfunctional organic radical;

R is H or $CH_3$;

R' is H or —C(O)C(R)═$CH_2$, with the proviso that —C(O)C(R)═$CH_2$ occurs at least once;

x is an integer 0–4 and indicates the number of functional groups on R" which are reactive with ethylene or propylene oxide;

z is an integer 1–4 and may vary independently of x and n;

n is an integer 0–20 and is independent of x and z; and wherein if any of R, R', or R" are greater than one, their identities and the number of each may be the same or different.

As used herein, the term "any organic radical" refers to any organic radical which can be attached to a hydroxyl moiety. Typical examples include mono- or multi-functional aromatic or aliphatic functionalities, wherein the aliphatic functionalities may be unsaturated, saturated, straight, branched, or cyclic in configuration.

Examples of compounds of Formula I wherein n=0 include ethylene glycol diacrylate, ethylene glycol dimethacrylate, pentaerythritol tetramethacrylate, dipentaerythritol hydroxy pentacrylate, pentacrylate, diethylene glycol dimethacrylate, 1,6-hexane diacrylate, trimethylolpropane triacrylate, and tripropyleneglycol diacrylate, all of which are commercially available or readily prepared by techniques and procedures well known to one of ordinary skill in the art. For example, tripropylene glycol diacrylate is available from Sartomer or Radcure and pentacrylate is available as SR-2041 from Sartomer.

In addition, compounds of Formula I wherein n is an integer 1–20 may be prepared essentially as shown in Scheme A wherein all substituents are as previously defined unless otherwise specified.

SCHEME A

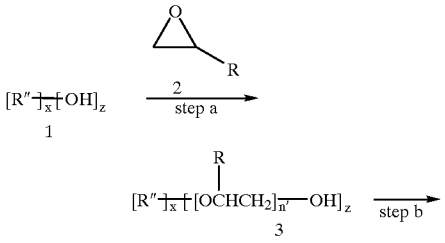

-continued

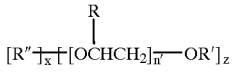

I n' = 1–20

Scheme A, step a, a polyhydric alcohol of formula 1 is reacted with an excess of an oxide of formula 2 to give a polyhydroxy polyether of formula 3. In step b, at least one of the hydroxy functionalities of the polyhydroxy polyether of formula 3 is esterified with acryloyl chloride or methacryloyl chloride to give the compounds of Formula I. Although depicted in Scheme A as complete esterification of all hydroxy functionalities of compounds of formula 3, it is understood that by varying the proportion of reagents, reactions times, and reaction temperatures, that some hydroxy functionalities of the compounds of formula 3 will not be esterified.

The compounds of Formula I may be used in the polymerizable transparentizing composition as individual compounds selected from Formula I or as mixtures of compounds selected from Formula I.

Suitable polyepoxides for use in this embodiment of the present invention are cycloaliphatic polyepoxides and include, but are not limited to the following:

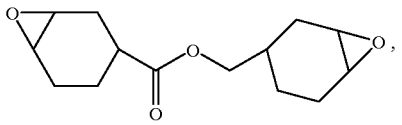

1

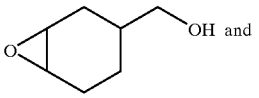

2

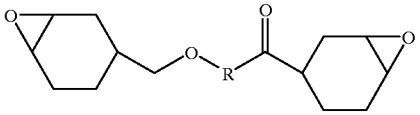

3 wherein R is a straight or branched chain, saturated or unsaturated $C_1$–$C_6$ alkyl. These cycloaliphatic polyepoxides are either commercially available or readily prepared by methods well known to those skilled in the art. For example, cycloaliphatic polyepoxide 1 is available as UVR-6110 from Union Carbide. These cycloaliphatic polyepoxides may be used in the polymerizable transparentizing composition as individual cycloaliphatic polyepoxides or as mixtures of cycloaliphatic polyepoxides. The linear cycloaliphatic diepoxides 3 are available from UCB Chemical Group, under the tradename E-CADE. The methyl hydroxy cycloaliphatic epoxide 2 is available as ETHB from UCB Chemical Group.

Suitable vinyl ethers for use in this embodiment of the present invention include, but are not limited to, vinyl pyrrolidone, hydroxybutyl vinyl ether, cyclohexandimethanol divinyl ether, polyester vinyl ether, fluoroalkyl vinyl ether, urethane divinyl ether, triethyleneglycol divinyl ether, vinyl/ether terminated urethane monomers and oligomers, and vinyl ether terminated ester monomers and oligomers. These vinyl ethers may be used in the polymerizable transparentizing composition as individual vinyl ethers or mixtures of vinyl ethers.

A wide variety of free-radical catalysts can be used provided they do not deleteriously affect the desired physical and chemical properties of the resultant transparentized portion. Suitable free radical catalysts for use in this embodiment of the present invention include, but are not limited to, xanthones, such as benzoin, ether, benzyldimethoxy ketone, acetophenones, such as 2,2 diethoxyacetophenone and t-butyl trichloroacetophenone, alkyl benzoin ethers, such as benzoin ether benzophenone, a benzophenone with an amine, such as methyl diethanolaminedimethylquinoxiline, 4,4'-bis(dimethylaminebenzophenone) and chloroacetophenone. A preferred class of useful free radical photocatalysts are haloalkyl substituted aryl ketone compounds. All such photocatalysts, useful in the practice of this invention, are either readily available commercially or are easily prepared using known techniques. For example, free radical catalyst 2-hydroxy-1-[4-(hydroxy-ethoxy)phenyl]-2-methyl-1-propane is available as Iracure 2959 from Ciba Geigy. The free radical catalysts may be used in the polymerizable transparentizing composition as individual free radical catalysts or as mixtures of free radical catalysts.

Suitable living cationic catalysts for use in this embodiment of the present invention include may be chosen from the family of triarylsulfonium salts or the family of diaryl iodonium salts which may be expressed by the general formula: $[Ar_xQ^+]_y Z_y^-$, where Ar is an aromatic radical, each independently having optional substitution; Q is a sulfur atom or iodine atom; x is 3 when Q is a sulfur atom; x is 2 when Q is an iodine atom; y is 1 or 2; and Z is $SbF_6$ or $PF_6$.

Representative living cationic catalysts of Formula III for use in this embodiment of the present invention include the following:

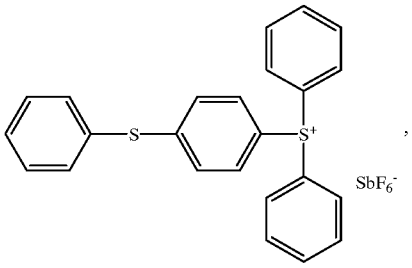

,

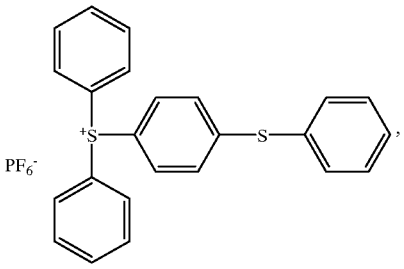

,

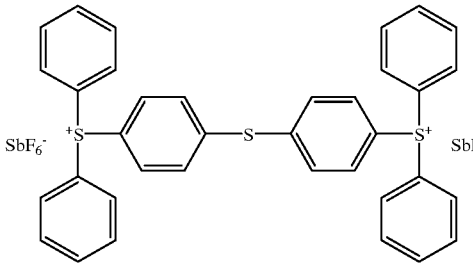

,

-continued

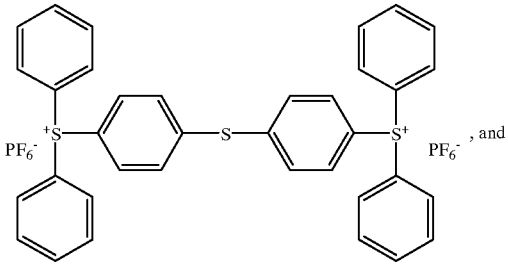

, and

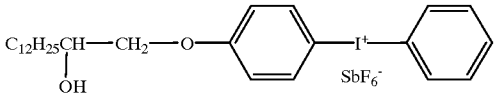

These living cationic catalysts are either commercially available or readily prepared by one of ordinary skill in the art. For example, a triarylsulfoniumhexafluoroantimonate salt is available as UVI 6974 from Union Carbide and a triarylsulfoniumhexafluorophosphate salt is available as UVI 6990 from Union Carbide or as CD-1011, available from Sartomer. These living cationic catalysts may be used in the polymerizable transparentizing composition as individual living cationic catalysts or as mixtures of living cationic catalysts.

As one of ordinary skill in the art will recognize, the polyepoxide and vinyl ether constituents of the polymerizable transparentizing agents are particularly amenable to cationic catalysis whereas the acrylate and methacrylate esters of Formula I are particularly amenable to free radical catalysis. Therefore, when a dual catalyst system (i.e., both free radical and living cationic) is utilized, the polymerizable transparentizing composition may include approximately equal amounts of free radical catalyzable constituent and cationic catalyzable constituent. However, when only a free radical catalyst is utilized, for optimum results, the predominate monomer in the transparentizing composition should be the free radical catalyzable constituent. And when only a living cationic catalyst is utilized, for optimum results, the predominate monomer in the transparentizing composition should be the cationic catalyzable constituent.

Although the radiation curable transparentizing materials of this embodiment of the present invention penetrate the fastest when used without oligomers or prepolymers, there may be occasions when the need for specific physical and/or chemical properties in the transparentized portion outweigh the need for high speed penetration. In such circumstances, oligomers and/or prepolymers may be included in the coating. For example, it may be desirable to include one or more prepolymers in the transparentizing material if, due to the nature of the cellulosic substrate, for instance, it were necessary to adjust the refractive index of the transparentizing material in order to ensure that the cured transparentizing material has a refractive index close to that of the cellulosic substrate. The preferred prepolymers for this purpose are selected from the group consisting of styrene-maleic anhydride prepolymer, styrene-acrylic acid prepolymer, and styrene-methacrylic acid prepolymer. Similarly, it may also be necessary in certain situations to have a transparentized portion with extra flexibility. In such situations, an oligomer may be included in the polymerizable transparentizing composition as part of the free radical catalyzable reactant material. Suitable oligomers are aromatic or non-aromatic acrylates or methacrylates and include, for example, urethane acrylates, such EBECRYL™ 6700 and EBECRYL™ 270, available from Rad-Cure, urethane methacrylates, epoxy acrylates, such as EBECRYL™ 3500 EBECRYL™ 3201, available from Rad-Cure, epoxy methacrylates, polyester acrylates, polyester methacrylates, and mixtures thereof. These oligomers are commercially available or readily prepared by techniques and procedures well known to one of ordinary skill in the art. Whether or not a prepolymer and/or oligomer is included in the transparentizing material, however, it is preferable that the transparentizing material have a refractive index of about 1.5 after the transparentizing material has been cured. Further, the transparentized portion of the substrate preferably has a thickness in the range of from about 0.0005 to about 0.002 inches (i.e., about $1.27\times10^{-3}$ cm to about $5.08\times10^{-3}$ cm). used herein, the term "oligomer and/or prepolymer component" refers to an individual oligomer, an individual prepolymer, a mixture of individual oligomers, a mixture of individual prepolymers, and a mixture of at least one of an oligomer and at least one of a prepolymer.

Without oligomers or prepolymers, the radiation curable transparentization material of this embodiment of the present invention penetrates a cellulosic substrate quite rapidly and can be applied as a "100% solids" and still achieve a rapid rate of penetration. "100% solids" means a liquid material which can be converted 100% to a solid upon curing (i.e., crosslinking or polymerization). Thus, it contains no residual volatiles or solvents. However, if even faster penetration is desired, a polar organic solvent can be added to the coating to lower the viscosity thereof. Preferred solvents are solvents which are polar and miscible with water and include methanol, ethanol, isopropanol, acetone and the like.

The polymerizable transparentizing composition may further include from about 0.2% to about 1% of an additive to reduce surface tension of the polymerizable liquid transparentizing material in order to increase the rate of penetration into the substrate, thus increasing production speed. These additives may be used in the polymerizable transparentizing composition as individual additives or as mixtures of additives. Suitable additives are fluorocarbons, such as FC-171 and FC-129, available from 3M or silicon prepolymers, such as SILRET 77 or DC-90, available from Union Carbide.

The radiation curable transparentizing composition of this embodiment of the present invention, without oligomers, prepolymers, or additives, comprises from about 10% to about 50% of a cationic catalyzable constituent; from about 40% to about 80% of a free radical catalyzable constituent; and from about 5% to about 16% of a catalyst constituent. Thus, a typical transparentizing composition of this embodiment of the present invention, without oligomers, prepolymers, or additives comprises 1) from about 10% to about 50% of any of a vinyl ether, polyepoxide, mixtures of vinyl ethers, mixtures of polyepoxides, or mixture of at least one of a vinyl ether and at least one of a polyepoxide; 2) from about 40% to about 80% of at least one of a compound of Formula I; and 3) from about 5 to about 16% of at least one of a free radical catalyst, at least one of a living cationic catalyst, or a mixture of at least one of a free radical catalyst and at least one of a living cationic catalyst.

Thus, according to the above, typical radiation curable transparentizing compositions, without oligomers, prepolymers, or additives, are exemplified by the following examples 1–8:

EXAMPLE 1 a) from about 25% to about 40% of at least one of a polyepoxide;
b) from about 40% to about 60% of at least one of a compound of Formula I; and
c) from about 5% to about 10% of at least one of a free radical catalyst.

EXAMPLE 2 a) from about 30% to about 35% of at least one of a polyepoxide;
b) from about 55% to about 60% of at least one of a compound of Formula I; and
c) from about 8% to about 10% of at least one of a living cationic catalyst.

EXAMPLE 3 a) from about 30% to about 40% of at least one of a polyepoxide;
b) from about 50% to about 60% of at least one of a compound of Formula I;
c) from about 3% to about 8% of at least one of a free radical catalyst; and
d) from about 3% to about 8% of at least one of a living cationic catalyst.

EXAMPLE 4 a) from about 10% to about 30% of at least one of a vinyl ether;
b) from about 60% to about 70% of at least one of a compound of Formula I; and
c) from about 8% to about 12% of at least one of a living cationic catalyst.

EXAMPLE 5 a) from about 10% to about 20% of at least one of a vinyl ether;
b) from about 60% to about 70% of at least one of a compound of Formula I;
c) from about 5% to about 6% of at least one of a free radical catalyst; and
d) from about 5% to about 7% of at least one of a living cationic catalyst.

EXAMPLE 6 a) from about 20% to about 30% of at least one of a polyepoxide;
b) from about 10% to about 15% of at least one of a vinyl ether;
c) from about 40% to about 50% of at least one of a compound of Formula I; and
d) from about 5% to about 10% of at least one of a living cationic catalyst.

EXAMPLE 7 a) from about 20% to about 30% of at least one of a polyepoxide;
b) from about 10% to about 15% of at least one of a vinyl ether;
c) from about 40% to about 50% of at least one of a compound of Formula I; and
d) from about 8% to about 10% of at least one of a free radical catalyst.

EXAMPLE 8 a) from about 20% to about 30% of at least one of a polyepoxide;

b) from about 10% to about 15% of at least one of a vinyl ether;

c) from about 40% to about 45% of at least one of a compound of Formula I;

d) from about 4% to about 6% of at least one of a free radical catalyst; and e) from about 8% to about 10% of at least one of a living cationic catalyst.

The radiation curable transparentizing composition of this embodiment of the present invention, without oligomers or prepolymers, but with additives, comprises from about 10% to about 50% of a cationic catalyzable constituent; from about 40% to about 80% of a free radical catalyzable constituent; from about 5% to about 13% of a catalyst constituent; and from about 0.5% to about 3% of an additive constituent. Thus, a typical transparentizing composition of this embodiment of the present invention, without oligomers or prepolymers, but with additives comprises 1) from about 10% to about 50% of any of a vinyl ether, polyepoxide, mixtures of vinyl ethers, mixtures of polyepoxides, or mixture of at least one of a vinyl ether and at least one of a polyepoxide; 2) from about 40% to about 80% of at least one of a compound of Formula I; 3) from about 5 to about 13% of at least one of a free radical catalyst, at least one of a living cationic catalyst, or a mixture of at least one of a free radical catalyst and at least one of a living cationic catalyst; and 4) from about 0.5% to about 3% of an additive or mixture of additives.

Thus, according to the above, typical radiation curable transparentizing compositions, without oligomers or prepolymers, but with an additive are exemplified by the following examples 9–16:

EXAMPLE 9 a) from about 25% to about 35% of at least one of a polyepoxide;

b) from about 50% to about 70% of at least one of a compound of Formula I;

c) from about 5% to about 10% of at least one of a free radical catalyst; and d) from about 1 to about 3% of an additive or mixture of additives.

EXAMPLE 10 a) from about 30% to about 35% of at least one of a polyepoxide;

b) from about 50% to about 55% of at least one of a compound of Formula I;

c) from about 8% to about 10% of at least one of a living cationic catalyst; and d) from about 1% to about 2% of an additive or mixture of additives.

EXAMPLE 11 a) from about 25% to about 40% of at least one of a polyepoxide;

b) from about 40% to about 60% of at least one of a compound of Formula I;

c) from about 2% to about 5% of at least one of a free radical catalyst;

d) from about 4% to about 6% of at least one of a living cationic catalyst; and e) from about 1% to about 2% of an additive or mixture of additives.

EXAMPLE 12 a) from about 10% to about 20% of at least one of a vinyl ether;

b) from about 60% to about 70% of at least one of a compound of Formula I;

c) from about 8% to about 10% of at least one of a living cationic catalyst; and d) from about 1% to about 2% of an additive or mixture of additives.

EXAMPLE 13 a) from about 10% to about 20% of at least one of a vinyl ether;

b) from about 60% to about 70% of at least one of a compound of Formula I;

c) from about 5% to about 6% of a free radical catalyst;

d) from about 5% to about 7% of at least one of a living cationic catalyst; and e) from about 1% to about 2% of an additive or mixture of additives.

EXAMPLE 14 a) from about 20% to about 30% of at least one of a polyepoxide;

b) from about 10% to about 15% of at least one of a vinyl ether;

c) from about 40% to about 50% of at least one of a compound of Formula I;

d) from about 5% to about 10% of at least one of a living cationic catalyst; and e) from about 0.5% to about 1% of an additive or mixture of additives.

EXAMPLE 15 a) from about 20% to about 30% of at least one of a polyepoxide;

b) from about 10% to about 15% of at least one of a vinyl ether;

c) from about 40% to about 50% of at least one of a compound of Formula I;

d) from about 5% to about 10% of at least one of a free radical catalyst; and e) from about 0.5% to about 1% of an additive or mixture of additives.

EXAMPLE 16 a) from about 20% to about 30% of at least one of a polyepoxide;

b) from about 10% to about 15% of at least one of a vinyl ether;

c) from about 40% to about 45% of at least one of a compound of Formula I;

d) from about 3% to about 5% of at least one of a free radical catalyst;

e) from about 6% to about 8% of at least one of a living cationic catalyst; and f) from about 0.5% to about 1% of an additive or mixture of additives.

The radiation curable transparentizing composition of this embodiment of the present invention, with oligomers and/or prepolymers, but without additives, comprises from about 10% to about 50% of a cationic catalyzable constituent; from about 40% to about 80% of a free radical catalyzable constituent; from about 5% to about 13% of a catalyst constituent; and from about 2% to about 50%, preferably from about 2% to about 12% of an oligomer and/or prepolymer component. Thus, a typical transparentizing composition of this embodiment of the present invention, with oligomers and/or prepolymers, but without additives comprises 1) from about 10% to about 50% of any of a vinyl ether, polyepoxide, mixtures of vinyl ethers, mixtures of polyepoxides, or mixture of at least one of a vinyl ether and at least one of a polyepoxide; 2) from about 40% to about 80% of at least one of a compound of Formula I; 3) from about 5 to about 13% of at least one of a free radical catalysts, at least one of a living cationic catalyst, or a mixture of at least one of a free radical catalyst and at least one of a living cationic catalyst; and 4) from about 2% to about 50%, preferably from about 2% to about 12% of an oligomer and/or prepolymer component.

Thus, according to the above, typical radiation curable transparentizing compositions, with oligomers, prepolymers, but without an additive component are exemplified by the following examples 17–24:

EXAMPLE 17 a) from about 25% to about 35% of at least one of a polyepoxide;
b) from about 50% to about 70% of at least one of a compound of Formula I;
c) from about 4% to about 6% of at least one of a free radical catalyst; and
d) from about 3 to about 6% of an oligomer and/or prepolymer component.

EXAMPLE 18 a) from about 30% to about 35% of at least one of a polyepoxide;
b) from about 50% to about 55% of at least one of a compound of Formula I;
c) from about 5% to about 10% of at least one of a living cationic catalyst; and
d) from about 5% to about 8% of an oligomer and/or prepolymer component.

EXAMPLE 19 a) from about 30% to about 40% of at least one of a polyepoxide;
b) from about 50% to about 60% of at least one of a compound of Formula I;
c) from about 3% to about 4% of at least one of a free radical catalyst;
d) from about 4% to about 6% of at least one of a living cationic catalyst; and
e) from about 3% to about 4% of an oligomer and/or prepolymer component.

EXAMPLE 20 a) from about 12% to about 20% of at least one of a vinyl ether;
b) from about 60% to about 70% of at least one of a compound of Formula I;
c) from about 8% to about 10% of at least one of a living cationic catalyst; and
d) from about 5% to about 10% of an oligomer and/or prepolymer component.

EXAMPLE 21 a) from about 10% to about 20% of at least one of a vinyl ether;
b) from about 60% to about 70% of at least one of a compound of Formula I;
c) from about 5% to about 6% of at least one of a free radical catalyst;
d) from about 5% to about 7% of at least one of a living cationic catalyst; and
e) from about 4% to about 5% of an oligomer and/or prepolymer component.

EXAMPLE 22 a) from about 20% to about 30% of at least one of a polyepoxide;
b) from about 10% to about 15% of at least one of a vinyl ether;
c) from about 40% to about 45% of at least one of a compound of Formula I;
d) from about 5% to about 10% of at least one of a living cationic catalyst; and
e) from about 4% to about 5% of an oligomer and/or prepolymer component.

EXAMPLE 23 a) from about 20% to about 30% of at least one of a polyepoxide;
b) from about 10% to about 15% of at least one of a vinyl ether;
c) from about 40% to about 45% of at least one of a compound of Formula I;
d) from about 8% to about 10% of at least one of a free radical catalyst; and
e) from about 4% to about 5% of an oligomer and/or prepolymer component.

EXAMPLE 24 a) from about 20% to about 30% of at least one of a polyepoxide;
b) from about 10% to about 15% of at least one of a vinyl ether;
c) from about 40% to about 45% of at least one of a compound of Formula I;
d) from about 3% to about 5% of at least one of a free radical catalyst;
e) from about 6% to about 8% of at least one of a living cationic catalyst; and
f) from about 3% to about 5% of an oligomer and/or prepolymer component.

The radiation curable transparentizing composition of this embodiment of the present invention, with oligomers and/or prepolymers, and with additives, comprises from about 10% to about 50% of a cationic catalyzable constituent; from about 30% to about 80% of a free radical catalyzable constituent; from about 5% to about 13% of a catalyst constituent; from about 1% to about 50%, preferably from about 1% to about 10% of an oligomer and/or prepolymer component; and from about 0.2% to about 2% of an additive. Thus, a typical transparentizing composition of this embodiment of the present invention, with oligomers and/or prepolymers, and with additives comprises 1) from about 10% to about 50% of any of a vinyl ether, polyepoxide, mixtures of vinyl ethers, mixtures of polyepoxides, or mixture of at least one of a vinyl ether and at least one of a polyepoxide; 2) from about 30% to about 80% of at least one of a compound of Formula I; 3) from about 5% to about 13% of at least one of a free radical catalyst, at least one of a living cationic catalyst, or a mixture of at least one of a free radical catalyst and at least one of a living cationic catalyst; 4) from about 1% to about 50%, preferably from about 1% to about 10% of an oligomer and/or prepolymer component; and 5) from about 0.2% to about 2% of an additive or mixture of additives.

Thus, according to the above, typical radiation curable transparentizing compositions, with oligomers and/or prepolymers and with an additive component are exemplified by the following examples 25–32:

EXAMPLE 25 a) from about 25% to about 35% of at least one of a polyepoxide;
b) from about 50% to about 70% of at least one of a compound of Formula I;
c) from about 4% to about 6% of at least one of a free radical catalyst;
d) from about 3 to about 5% of an oligomer and/or prepolymer component; and
e) from about 0.5% to about 2% of an additive or mixture of additives.

EXAMPLE 26 a) from about 30% to about 35% of at least one of a polyepoxide;
b) from about 50% to about 55% of at least one of a compound of Formula I;
c) from about 5% to about 10% of at least one of a living cationic catalyst;
d) from about 5% to about 8% of an oligomer and/or prepolymer component; and
e) from about 1% to about 2% of an additive or mixture of additives.

EXAMPLE 27 a) from about 10% to about 30% of at least one of a polyepoxide;
b) from about 30% to about 60% of at least one of a compound of Formula I;
c) from about 3% to about 6% of at least one of a free radical catalyst;
d) from about 2% to about 6% of at least one of a living cationic catalyst;
e) from about 1% to about 10% of an oligomer and/or prepolymer component; and
f) from about 0.2% to about 1% of an additive or mixture of additives.

EXAMPLE 28 a) from about 10% to about 20% of at least one of a vinyl ether;
b) from about 60% to about 70% of at least one of a compound of Formula I;
c) from about 8% to about 10% of at least one of a living cationic catalyst;
d) from about 5% to about 10% of an oligomer and/or prepolymer component; and
e) from about 1% to about 2% of an additive or mixture of additives.

EXAMPLE 29 a) from about 10% to about 20% of at least one of a vinyl ether;
b) from about 60% to about 70% of at least one of a compound of Formula I;
c) from about 5% to about 6% of at least one of a free radical catalyst;
d) from about 5% to about 7% of at least one of a living cationic catalyst;
e) from about 4% to about 5% of an oligomer and/or prepolymer component; and
f) from about 1% to about 2% of an additive or mixture of additives.

EXAMPLE 30 a) from about 20% to about 30% of at least one of a polyepoxide;
b) from about 10% to about 15% of at least one of a vinyl ether;
c) from about 40% to about 45% of at least one of a compound of Formula I;
d) from about 5% to about 10% of at least one of a living cationic catalyst;
e) from about 4% to about 6% of an oligomer and/or prepolymer component; and
f) from about 0.5% to about 1% of an additive or mixture of additives.

EXAMPLE 31 a) from about 20% to about 30% of at least one of a polyepoxide;
b) from about 10% to about 15% of at least one of a vinyl ether;
c) from about 40% to about 45% of at least one of a compound of Formula I;
d) from about 5% to about 10% of at least one of a free radical catalyst;
e) from about 4% to about 6% of an oligomer and/or prepolymer component; and
f) from about 0.5% to about 1% of an additive or mixture of additives.

EXAMPLE 32 a) from about 20% to about 30% of at least one of a polyepoxide;
b) from about 10% to about 15% of at least one of a vinyl ether;

c) from about 40% to about 45% of at least one of a compound of Formula I;

d) from about 3% to about 5% of at least one of a free radical catalyst;

e) from about 6% to about 8% of at least one of a living cationic catalyst;

f) from about 3% to about 5% of an oligomer and/or prepolymer component; and g) from about 0.5% to about 1% of an additive or mixture of additives.

A preferred radiation-curable transparentizing composition of this embodiment of the present invention comprises:

a) from about 30% to about 40% of a polyepoxide of the formula

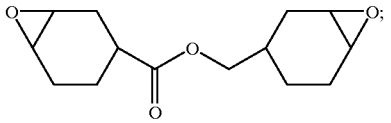

b) from about 50% to about 60% of tripropyleneglycol diacrylate;

c) from about 3% to about 6% of pentacrylate;

d) about 4.5% of 2-hydroxy-1-[4-(hydroxy-ethoxy) phenyl]-2-methyl-1-propane; and e) about 5.5% of a triarylsulfonium hexafluorophosphate salt of the formula

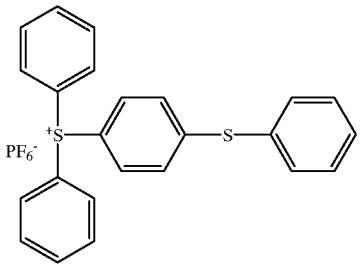

A more preferred radiation-curable transparentizing composition of this embodiment of the present invention comprises:

a) from about 30% to about 32% of a polyepoxide of the formula

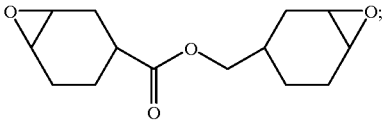

b) from about 52% to about 55% of tripropyleneglycol diacrylate;

c) from about 4% to about 5% of pentacrylate;

d) about 4.5% of 2-hydroxy-1-[4-(hydroxy-ethoxy) phenyl]-2-methyl-1-propane; and e) about 5.5% of a triarylsulfonium hexafluorophosphate salt of the formula

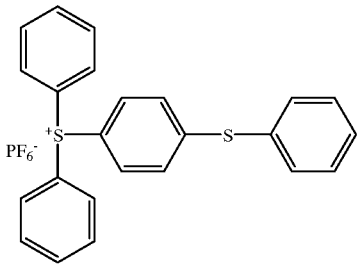

A still more preferred radiation-curable transparentizing composition of this embodiment of the present invention comprises:

a) about 31.5% of a polyepoxide of the formula

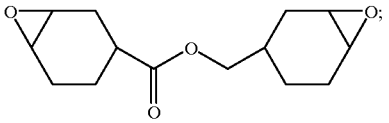

b) about 54% of tripropyleneglycol diacrylate;

c) about 4.5% of pentacrylate;

d) about 4.5% of 2-hydroxy-1-[4-(hydroxy-ethoxy) phenyl]-2-methyl-1-propane; and e) about 5.5% of a triarylsulfonium hexafluorophosphate salt of the formula

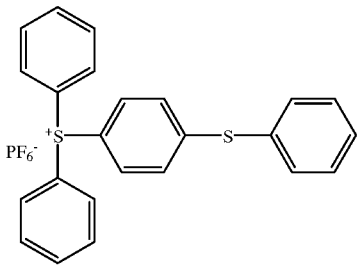

Yet a still more preferred radiation-curable transparentizing composition of this embodiment of the present invention comprises:

a) about 31.5% of a polyepoxide of the formula

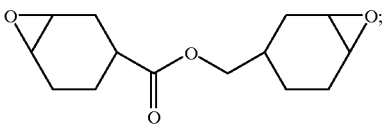

b) about 54% of tripropyleneglycol diacrylate;

c) about 4.5% of pentacrylate;

d) about 4.5% of 2-hydroxy-1-[4-(hydroxy-ethoxy) phenyl]-2-methyl-1-propane; and e) about 5.5% of a triarylsulfonium hexafluorophosphate salt of the formula

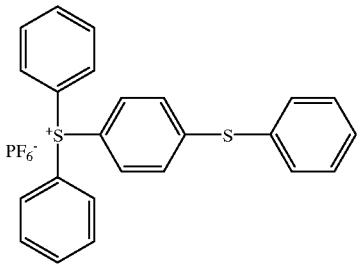

Preferably, the polymerizable transparentizing composition is cured by exposure to one of radiation-either electron beam, visible or ultraviolet radiation. Curing causes the polymerizable constituents of the transparentizing material to polymerize, thus making a permanently transparentized portion. Once the transparentizing composition is cured, it is a solid and will not migrate or volatilize. Advantageously, the rapidity with which the present transparentizing material penetrates the substrate allows curing thereof almost immediately following its application to the substrate, thus providing substantially no opportunity for the material to migrate or volatilize beyond the area to which it has been applied. The liquid polymerizable transparentizing compositions of this embodiment of the present invention are cured rapidly and completely. For example, transparentizing compositions of this embodiment of the present invention which contain both free radical and living cationic catalysts will typically demonstrate a 95% or greater completion of cross-linking reactions. In addition, compositions containing living cationic catalysts, either alone or in combination with free radical catalysts, will continue to cure to some extent even after exposure to radiation has ceased. And while the application of radiation alone activates both the free radical and living cationic catalysts components of the polymerizable transparentizing composition to initiate cross-linking, the crosslinking rate may be enhanced by the application of heat which may be conveniently provided by infrared radiation. Heat is particularly effective in promoting the activity of the cationic catalyst.

The speed at which the transparentizing material of this embodiment of the present invention penetrates a substrate allows transparentizing to occur in a continuous, in-line process. Such a process can include any conventional printing method such as flexographic, gravure, or screen. A continuous transparentization process can be set up in which the transparentizing material is first applied to an area in a flexographic printing press and then cured immediately thereafter by electron beam, visible, or ultraviolet radiation.

In the case of a flexographic printing press in combination with ultraviolet curing, for example, an acceptable rate of transparentization (i.e., applying the transparentizing material to a substrate and curing it) is from about 75 to about 150 linear feet (i.e., about 22.9 meters to about 45.72 meters) of substrate per minute. Obviously faster production speeds are usually preferred. One expedient for increasing production speed is to mildly heat the substrate and/or transparentizing material (50° C.–100° C.) to effectively reduce viscosity and increase the penetration rate. The preferred viscosity of the coating at 25° C. is from about 30 to about 100 centipoise and more preferably from about 30 to about 70 centipoise. The preferred wavelength of the ultraviolet curing light is from about 200 to about 400 nanometers, and the preferred ultraviolet curing light capacity is from about 300 to about 600 watts per inch of substrate width.

The transparentizing material can be applied to one or both sides of a substrate. It is preferred, however, that it be applied simultaneously to both sides. Such simultaneous application provides even faster penetration of the transparentizing material into the substrate.

Advantageously, the use of polymerizable transparentizing composition of this embodiment of the present invention, without oligomers or prepolymers, results in a transparentizing material which not only penetrates a substrate quickly, but also produces a transparentized portion which meets all of the desired physical and chemical properties. Physically, the transparentized portion is strong, flexible and durable such that it will maintain its transparency when subjected to rough handling. In addition, the transparentized portion is highly receptive to inks and/or toners.

Chemically, the transparentized portion has sufficient resistance to ultraviolet radiation that it does not lose its transparency over time. The transparentized portion meets U.S. Postal Service specifications for reflectance and PCR. This is believed possible due to the fact that the above-recited monomers achieve substantially complete penetration of substrate. Additionally, the transparentized portion has sufficient resistance to migration and/or volatilization of the radiation cured transparentizing material that it does not lose its transparency over time. Due to the rapid penetration of the transparentizing material into the substrate, the transparentizing material can be cured almost immediately after it has been applied. Moreover, although compatible with polar organic solvents, the transparentizing material of this embodiment of the present invention does not require the use of organic solvents. Therefore, it is less volatile after curing than one containing an organic solvent, thus further reducing the tendency to migrate or volatilize.

It is preferred that the transparentizing material, once cured, have a refractive index as close as possible to that of the substrate. This will ensure that the transparentized portion will be sufficiently transparent. Most cellulosic substrates have a refractive index of around 1.5. Thus, the preferred refractive index of the cured coating is similarly around 1.5. However, some cellulosic substrates have a refractive index which is greater than 1.5. With such substrates, it may be desirable to include one or more prepolymers with the transparentizing material in order to increase the refractive index of the cured transparentizing material to substantially match that of the substrate. Typically, 1.55 is the highest value that the refractive index of the cured transparentizing material will need to attain in this manner. The preferred prepolymers for this function include styrene-maleic anhydride, styrene-acrylic acid and, styrene-methacrylic acid. The most preferred prepolymer of this group is styrene-maleic anhydride.

It may also be desirable in certain situations to have a transparentized portion with extra flexibility. For this purpose, an oligomer may be included with the transparentizing material. The preferred oligomers in this instance are urethane acrylate oligomer and styrene-acrylic oligomer.

Transparentizing Composition According to Another Embodiment of the Present Invention In this embodiment of this embodiment of the present invention, a polymeric transparentizing material is provided comprising at least one monomer selected from the group consisting of acrylic esters of polyhydric alcohols, methacrylic esters of polyhydric alcohols, and vinyl ethers which have been cured by exposure to radiation. Such monomers are characterized by having one or more ethylenically unsaturated groups per monomer molecule. In one embodiment, in which the transparentized portion is impregnated with the above-recited radiation curable fluid, the radiation curable fluid is preferably applied as 100% solids (i.e., solventless) liquid. Application in such a manner is advantageous in that the use of the above-recited monomers, without oligomers or prepolymers, causes the liquid to penetrate the cellulosic substrate quickly and completely. In addition, radiation curing of the liquid is preferred in that it is faster and more reliable than other forms of curing such as, for example, heat curing. These features thus permit continuous, in-line transparentization. Another advantage of the above-recited monomeric liquid is that quick penetration is achieved without the need for solvents. Thus, the liquid which is applied can be a 100% solids composition to eliminate the need for evaporation and recovery of solvent from the substrate.

A further advantage of the use of the above-recited monomers, without oligomers or prepolymers, is that even though the liquid penetrates the substrate very quickly, the transparentized portion produced by the coating is a high quality one. Physically, the transparentized portion is strong and flexible and is highly receptive to inks.

Chemically, the transparentized portion of this embodiment of this embodiment of the present invention has sufficient resistance to ultraviolet radiation that it does not yellow and/or lose its transparency over time. It is believed that such resistance to ultraviolet radiation is a result of the aliphatic, as opposed to aromatic, structure of the above-recited monomers. Further, the transparentized portion meets U.S. Postal Service specifications for reflectance and PCR. This is believed possible due to the fact that the above-recited monomers penetrate the substrate substantially completely. Additionally, the present transparentized portion has sufficient resistance to migration and/or volatilization of the radiation cured material that it does not lose its transparency over time. This advantage is believed due to the facts that the liquid which is applied is 100% solids, and the liquid transparentizing material can be radiation cured almost immediately after it has been applied to the substrate since it penetrates the substrate so quickly.

Although the radiation curable transparentizing material of this embodiment of this embodiment of the present invention penetrates the fastest when the above-recited monomers are used without oligomers or prepolymers, there may be occasions when the need for specific physical and/or chemical properties in the transparentized portion outweigh the need for high speed penetration. In such circumstances, oligomers and/or prepolymers may be included in the coating. For example, it may be desirable to include one or more prepolymers with the coating if, due to the nature of the cellulosic substrate, for instance, it were necessary to adjust the refractive index of the coating in order to ensure that the cured coating has a refractive index close to that of the cellulosic substrate. The preferred prepolymers for this purpose are selected from the group consisting of styrene-maleic anhydride prepolymer, styrene-acrylic acid prepolymer, and styrene-methacrylic acid prepolymer. Similarly, it may also be necessary in certain situations to have a transparentized portion with extra flexibility. In such situations, an oligomer may be included with the coating. The preferred oligomers are selected from the group consisting of styrene-acrylic acid oligomers and urethane acrylate oligomers. Whether or not a prepolymer is included with the coating, however, it is preferable that the coating have a refractive index of about 1.5 after the coating has been cured. Further, the transparentized portion of the substrate preferably has a thickness in the range of from about 0.0005 to about 0.002 inches.

In some embodiments of the present invention, a predetermined portion of the substrate is made thinner than the remainder of the substrate and a transparentizing material is applied to the predetermined portion. Preferably, such transparentizing coating material comprises one or more monomers selected from the group consisting of acrylic esters of polyhydric alcohols, methacrylic esters of polyhydric alcohols, and vinyl ethers. Preferably, the transparentizing material is a 100% solids radiation curable coating, with the radiation curable coating further including a prepolymer or oligomer. Preferably, the prepolymer is selected from the group consisting of styrene-maleic anhydride prepolymer, styrene-acrylic acid prepolymer, and styrene-methacrylic acid prepolymer. Additionally, the radiation curable coating can include an oligomer such as a urethane acrylate oligomer or a styrene-acrylic oligomer.

As mentioned, the speed at which the above-recited monomeric transparentizing liquid coating penetrates allows transparentizing to occur in a continuous, in-line process. Such a process may be a continuous flexographic printing process in which the step of applying a radiation curable liquid to the predetermined portion occurs in the continuous flexographic printing process. The liquid is then cured immediately thereafter as a subsequent step in the continuous process. Preferably, those steps occur at a speed of about 75 to about 150 linear feet of substrate per minute.

To provide even faster penetration of the liquid into the substrate, the step of applying a radiation curable liquid to the predetermined portion can occur simultaneously to both the upper and lower surfaces of the predetermined portion.

In rendering the predetermined portion thinner than the remainder of the substrate, that may be accomplished by compressing, such as by calendaring the predetermined portion to a predetermined thickness. Preferably, such predetermined thickness ranges from about 0.0005 inches to about 0.002 inches following the compression of the predetermined portion. Alternatively, the predetermined portion can be made thinner by mechanically grinding the portion. Preferably, the predetermined portion has a thickness ranging from about 0.0005 inches to about 0.002 inches following the grinding operation.

According to this embodiment of the present invention, a substrate is impregnated with a radiation curable liquid transparentizing material. The radiation curable liquid comprises one or more monomers selected from the group consisting of vinyl ethers and acrylic and methacrylic esters of polyhydric alcohols. Representative examples include: ethylene glycol diacrylate, ethylene glycol dimethacrylate, trimethylolpropane triacrylate, pentaerythritol tetramethacrylate, dipentaerythritol hydroxy pentacrylate, 1,6-hexanediol diacrylate, diethylene glycol dimethacrylate. A representative example of a vinyl ether monomer is vinyl pyrrolidone.

Such monomers are aliphatic and have one or more ethylenically unsaturated groups. It has been found that when one or more of these monomers, without oligomers or prepolymers, are included in a radiation curable transparentization coating, the liquid coating penetrates a cellulosic substrate quite rapidly. It is believed that the rapid penetration is due, in part, to the inherently low viscosity of such monomers. Thus, the coating can be a "100% solids" one and still achieve a rapid rate of penetration. "100% solids" means a liquid material which can be converted 100% to a solid upon curing (i.e. crosslinking or polymerization). Thus, it contains no residual volatiles or solvents. However, if even faster penetration is desired, an organic solvent can be added to the coating to further lower the viscosity thereof. Preferred solvents include isopropanol, methyl ethyl ketone, toluene, and hexyl carbitol (hexyl ether of diethylene glycol).

Preferably, the coating is cured by exposing the coating to one of two types of radiation—either electron beam radiation or ultraviolet radiation. Curing the coating causes the constituents to polymerize, thus making a permanently transparentized portion. Once the coating is cured, it is a solid and will not migrate or volatilize. Advantageously, the rapidity with which the present liquid transparentizing material penetrates the substrate allows curing thereof almost immediately following its application to the substrate, thus providing substantially no opportunity for the coating to migrate or volatilize.

If electron beam curing is employed, no photocatalyst is needed. However, if curing is carried out by exposing the coating to ultraviolet radiation, a photocatalyst needs to be included with the coating. Preferably, the photocatalyst is of the free radical type. A wide variety of such photocatalysts can be used provided they do not deleteriously affect the desired physical and chemical properties of the resultant transparentized portion. Examples of useful free radical photocatalysts include an alkyl benzoin ether, such as benzoin ether benzophenone, a benzophenone with an amine such as methyl diethanolaminedimethylquinoxiline 4,4' bis (di methylaminebenzophenone), and acetophenones such as 2,2 diethoxyacetophenone and t-butyl trichloroacetophenone. A preferred class of useful free radical photocatalysts are haloalkyl substituted aryl ketone compounds. All such photocatalysts, useful in the practice of this invention, are either readily available commercially or are easily prepared using known techniques.

The speed at which the monomeric radiation curable liquid of the present invention penetrates the substrate allows transparentizing to occur in a continuous, in-line process. Such a process can include any conventional printing method such as flexographic, gravure, screen, letterpress, or lithography. A continuous transparentization process can be set up in which the radiation curable liquid is first applied to an area in a flexographic printing press and then cured immediately thereafter by electron beam or ultraviolet radiation.

In the case of a flexographic printing press in combination with ultraviolet curing, for example, an acceptable rate of transparentization (i.e., applying the coating to the substrate and curing it) is from about 75 to about 150 linear feet of substrate per minute. Obviously faster production speeds are usually preferred. One expedient for increasing production speed is to mildly heat the substrate and/or liquid material (50–90° C.) to effectively reduce viscosity and increase the penetration rate. The preferred viscosity of the coating at 25° C. is from about 50 to about 100 centipoise and more preferably from about 50 to about 70 centipoise. The preferred wavelength of the ultraviolet curing light is from about 200 to about 400 nanometers and the preferred ultraviolet curing light capacity is from about 300 to about 400 watts per inch of substrate width.

The liquid transparentizing material can be applied to one or both sides of a substrate. It is preferred, however, that it be applied simultaneously to both sides. Such simultaneous application provides even faster penetration of the liquid into the substrate.

Advantageously, the use of one or more of the above-recited monomers, without oligomers or prepolymers, results in a coating which not only penetrates a substrate very quickly, but also produces a transparentized portion which meets all of the desired physical and chemical properties. Physically, the transparentized portion is strong, flexible and durable such that it will maintain its transparency when subjected to rough handling. In addition, transparentized portion is highly receptive to inks.

Chemically, the transparentized portion has sufficient resistance to ultraviolet radiation that it does not yellow and/or lose its transparency over time. It is believed that such resistance to ultraviolet radiation is a result of the aliphatic, as opposed to aromatic, structure of the above-recited monomers. Further, the transparentized portion meets U.S. Postal Service specifications for reflectance and PCR. This is believed possible due to the fact that the above-recited monomers achieve substantially complete penetration of the substrate. Additionally, the transparentized portion has sufficient resistance to migration and/or volatilization of the radiation cured coating that it does not lose its transparency over time. Due to the rapid penetration of the coating into substrate, the coating can be cured almost immediately after it has been applied. Moreover, when the coating is 100% solids, it is less mobile and less volatile after curing than one containing a solvent, thus further reducing the tendency to migrate or volatilize.

It is preferred that the transparentizing material, once cured, has a refractive index as close as possible to that of the substrate. This will ensure that the transparentized portion will be sufficiently transparent. Most cellulosic substrates have a refractive index of around 1.5. Thus, the preferred refractive index of the cured coating is similarly around 1.5. When the coating is comprised of one or more of the above-recited monomers, without oligomers or prepolymers, the refractive index of the cured coating ranges from about 1.48 to about 1.5. Under most circumstances, this matches closely enough with that of the cellulosic substrate that the transparentized portion will be sufficiently transparent.

However, some cellulosic substrates have a refractive index which is greater than 1.5. With such substrates, it may be desirable to include one or more prepolymers with the coating in order to increase the refractive index of the cured coating to substantially match that of the substrate. Typically, 1.55 is the highest value that the refractive index of the cured coating will need to attain in this manner. The preferred prepolymers for this function include styrene-maleic anhydride, styrene-acrylic acid and, styrene-methacrylic acid. The most preferred prepolymer of this group is styrene-maleic anhydride.

It may also be desirable in certain situations to have a transparentized portion with extra flexibility. For this purpose, an oligomer may be included with the coating. The preferred oligomers in this instance are urethane acrylate oligomer and styrene-acrylic oligomer.

Further, an amine may be included with the coating in order to reduce the curing time thereof. The preferred amine for this purpose is triethanol amine.

In order that the invention may be more readily understood, reference is made to the following examples, which are intended to be illustrative of the invention, but are not intended to be limiting in scope.

EXAMPLE 1

A radiation curable liquid transparentizing material was prepared in accordance with the present invention by blending the materials listed below. The liquid was then applied to a substrate by flexographic printing and cured by ultraviolet radiation at a wavelength of from about 200 to about 400 nanometers.

| | Percent by Weight |
|---|---|
| Styrene-maleic anhydride[1] | 7.24 |
| 1,6 Hexanedioldiacrylate[2] | 30.72 |
| Trimethylolpropane triacrylate[3] | 34.48 |
| Monohydroxy pentacrylate[4] | 4.82 |
| Urethane acrylate[5] | 10.34 |
| Photocatalyst[6] | 12.40 |

[1]SMA 1000A from Arco Chemical
[2]SR-238 from Sartomer
[3]SR-351 from Sartomer
[4]SR-9041 from Sartomer
[5]CN-962 from Sartomer
[6]Iracure 500 from Ciba Geigy

EXAMPLE 2

A radiation curable transparentizing liquid was prepared as in Example 1 using the following materials:

| | Percent by Weight |
|---|---|
| Styrene-maleic anhydride[1] | 6.67 |
| 1,6 Hexanedioldiacrylate[2] | 62.60 |
| Trimethylolpropane triacrylate[3] | 20.89 |
| Photocatalyst[4] | 9.84 |

[1]SMA 1000A from Arco Chemical
[2]SR-238 from Sartomer
[3]SR-351 from Sartomer
[4]Iracure 500 from Ciba Geigy

EXAMPLE 3

A radiation curable transparentizing liquid was prepared as in Example 1 using the following materials:

| | Percent by Weight |
|---|---|
| 1,6 Hexanedioldiacrylate[1] | 78.86 |
| Urethane acrylate[2] | 8.10 |
| Photocatalyst[3] | 13.04 |

[1]SR-238 from Sartomer
[2]CN-962 from Sartomer
[3]Iracure 500 from Ciba Geigy

EXAMPLE 4

A radiation curable transparentizing liquid was prepared as in Example 1 using the following materials:

| | Percent by Weight |
|---|---|
| Styrene-maleic anhydride[1] | 6.58 |
| 1,6 hexanedioldiacrylate[2] | 27.90 |
| Trimethylolpropane triacrylate[3] | 31.34 |
| Monohydroxy Pentacrylate[4] | 4.38 |
| Urethane acrylate[5] | 9.40 |

-continued

| | Percent by Weight |
|---|---|
| Hexyl carbitol | 9.20 |
| Photocatalyst[6] | 11.20 |

[1]SMA 1000A from Arco Chemical
[2]SR-238 from Sartomer
[3]SR-351 from Sartomer
[4]SR-9041 from Sartomer
[5]CN-962 from Sartomer
[6]Iracure 500 from Ciba Geigy

EXAMPLE 5

A radiation curable transparentizing liquid was prepared as in Example 1 using the following materials:

| | Percent by Weight |
|---|---|
| 1,6 Hexanedioldiacrylate[1] | 33.52 |
| Trimethylolpropane triacrylate[2] | 47.86 |
| Monohydroxy Pentacrylate[3] | 7.01 |
| Urethane acrylate[4] | 3.19 |
| Triethanol amine | 2.55 |
| Photocatalyst[5] | 5.87 |

[1]SR-238 from Sartomer
[2]SR-351 from Sartomer
[3]SR-9041 from Sartomer
[4]CN-962 from Sartomer
[5]Iracure 500 from Ciba Geigy

EXAMPLE 6

A radiation curable transparentizing liquid was prepared as in Example 1 using the following materials:

| | Percent by Weight |
|---|---|
| 1,6 Hexanedioldiacrylate[1] | 27.61 |
| Trimethylolpropane triacrylate[2] | 39.37 |
| Monohydroxy pentacrylate[3] | 5.51 |
| Vinyl pyrrolidone | 15.70 |
| Photocatalyst[4] | 11.81 |

[1]SR-238 from Sartomer
[2]SR-351 from Sartomer
[3]SR-9041 from Sartomer
[4]Iracure 500 from Ciba Geigy

EXAMPLE 7

A radiation curable transparentizing liquid was prepared as in Example 1 using the following materials:

| | Percent by Weight |
|---|---|
| 1,6 Hexanedioldiacrylate[1] | 28.22 |
| Trimethylolpropane triacrylate[2] | 40.35 |
| Monohydroxy pentacrylate[3] | 5.64 |

-continued

| | Percent by Weight |
|---|---|
| Tripropylene glycol diacrylate[4] | 16.12 |
| Photocatalyst[5] | 9.67 |

[1]SR-238 from Sartomer
[2]SR-351 from Sartomer
[3]SR-9041 from Sartomer
[4]Photomer 4061 from Henkel
[5]Iracure 500 from Ciba Geigy Having described the invention in detail and by reference to preferred embodiments thereof, it will be apparent that modifications and variations are possible without departing from the scope of the invention defined in the appended claims.

What is claimed is:

1. A cellulosic substrate having at least one transparentized portion formed therein, wherein:

said cellulosic substrate defines first and second major faces;

said transparentized portion comprises a transparentizing composition applied to said cellulosic substrate in a predetermined pattern so as to define a graphical image having a relative transparency selected so as to define an area of increased transparency in said substrate;

said area of increased transparency resembles a graphical watermark and defines a degree of transparency that excludes the degree of transparency defined by a transparent window;

said transparentizing composition comprises a transparentizing agent and a security agent.

2. A cellulosic substrate as claimed in claim 1 wherein said cellulosic substrate defines a textured portion and wherein said graphical image is further defined by said textured portion.

3. A cellulosic substrate as claimed in claim 2 wherein said textured portion and said transparentized portion lie in common areas of said cellulosic substrate.

4. A cellulosic substrate as claimed in claim 3 wherein said textured portion and said transparentized portion define substantially identical boundaries and wherein said textured portion and said transparentized portion are positioned in substantial alignment on said cellulosic substrate.

5. A cellulosic substrate as claimed in claim 2 wherein said textured portion defines a variable thickness profile and wherein said transparentizing composition is applied across said variable thickness profile such that said area of increased transparency defines a varying transparency.

6. A cellulosic substrate as claimed in claim 1 wherein said transparentized portion includes a printed portion, wherein printed matter defining the printed portion is covered by said transparentizing composition.

7. A cellulosic substrate as claimed in claim 6 wherein said printed portion lies in a reduced-thickness portion of said substrate.

8. A cellulosic substrate as claimed in claim 6 wherein said printed matter comprises an amount field of a negotiable document.

9. A cellulosic substrate as claimed in claim 6 wherein said printed matter comprises a secure data field.

10. A cellulosic substrate as claimed in claim 1 wherein said security agent comprises a photochromic agent.

11. A cellulosic substrate as claimed in claim 1 wherein said security agent comprises a thermochromic agent.

12. A cellulosic substrate as claimed in claim 1 wherein said security agent comprises a fluorescent agent.

13. A cellulosic substrate as claimed in claim 1 wherein said security agent comprises a coloring agent.

14. A cellulosic substrate as claimed in claim 1 wherein said security agent comprises a fragrance.

15. A cellulosic substrate as claimed in claim 1 wherein said security agent comprises a UV ink.

16. A cellulosic substrate as claimed in claim 1 wherein said transparentizing composition comprises a radiation-curable composition.

17. A cellulosic substrate as claimed in claim 1 wherein said transparentizing composition is selected so as to cure upon contact with said cellulosic substrate.

18. A cellulosic substrate having at least one transparentized portion formed therein, wherein:

said cellulosic substrate defines first and second major faces;

said transparentized portion comprises a transparentizing composition applied to said cellulosic substrate in a predetermined pattern so as to define a graphical image having a relative transparency selected so as to define an area of increased transparency in said substrate resembling a graphical watermark and defines a degree of transparency that excludes the degree of transparency defined by a transparent window;

said transparentizing composition comprises a transparentizing agent;

said transparentized portion includes a printed portion; and printed matter defining the printed portion is covered by said transparentizing composition.

19. A cellulosic substrate as claimed in claim 18 wherein said cellulosic substrate defines a textured portion and wherein said graphical image is further defined by said textured portion.

20. A cellulosic substrate as claimed in claim 19 wherein said textured portion and said transparentized portion lie in common areas of said cellulosic substrate.

21. A cellulosic substrate as claimed in claim 20 wherein said textured portion and said transparentized portion define substantially identical boundaries and wherein said textured portion and said transparentized portion are positioned in substantial alignment on said cellulosic substrate.

22. A cellulosic substrate as claimed in claim 19 wherein said textured portion defines a variable thickness profile and wherein said transparentizing composition is applied across said variable thickness profile such that said area of increased transparency defines a varying transparency.

23. A cellulosic substrate as claimed in claim 18 wherein said printed portion lies in a reduced-thickness portion of said substrate.

24. A cellulosic substrate as claimed in claim 18 wherein said printed matter comprises an amount field of a negotiable document.

25. A cellulosic substrate as claimed in claim 18 wherein said printed matter comprises a secure data field.

26. A cellulosic substrate having at least one transparentized portion formed therein, wherein:

said cellulosic substrate defines first and second major faces and a textured portion;

said transparentized portion comprises a transparentizing composition applied to said cellulosic substrate in a predetermined pattern;

said transparentizing composition and said textured portion define a graphical image having a relative transparency selected so as to define a textured area of increased transparency in said substrate;

said area of increased transparency resembles a graphical watermark; and said transparentizing composition comprises a transparentizing agent.

27. A cellulosic substrate as claimed in claim 26 wherein said textured portion and said transparentized portion lie in common areas of said cellulosic substrate.

28. A cellulosic substrate as claimed in claim 27 wherein said textured portion and said transparentized portion define substantially identical boundaries and wherein said textured portion and said transparentized portion are positioned in substantial alignment on said cellulosic substrate.

29. A cellulosic substrate as claimed in claim 26 wherein said textured portion defines a variable thickness profile and wherein said transparentizing composition is applied across said variable thickness profile such that said area of increased transparency defines a varying transparency.

30. A cellulosic substrate having at least one transparentized portion formed therein, wherein said cellulosic substrate defines first and second major faces, said transparentized portion comprises a radiation-curable transparentizing composition applied to said cellulosic substrate in a predetermined pattern so as to define a graphical image having a relative transparency selected so as to define an area of increased transparency in said substrate resembling a graphical watermark and defines a degree of transparency that excludes the degree of transparency defined by a transparent window, and wherein said radiation-curable transparentizing composition comprises at least one monomer selected from the group consisting of acrylic esters of polyhydric alcohols, methacrylic esters of polyhydric alcohols, and vinyl esters.

31. A cellulosic substrate having at least one transparentized portion formed therein, wherein said cellulosic substrate defines first and second major faces, said transparentized portion comprises a radiation-curable transparentizing composition applied to said cellulosic substrate in a predetermined pattern so as to define a graphical image having a relative transparency selected so as to define an area of increased transparency in said substrate resembling a graphical watermark and defines a degree of transparency that excludes the degree of transparency defined by a transparent window, and wherein said radiation-curable transparentizing composition comprises a polymer consisting of aliphatic monomers selected from the group consisting of acrylic esters of polyhydric alcohols, methacrylic esters of polyhydric alcohols, and vinyl esters.

32. A cellulosic substrate having at least one transparentized portion formed therein, wherein said cellulosic substrate defines first and second major faces, said transparentized portion comprises a transparentizing composition applied to said cellulosic substrate in a predetermined pattern so as to define a graphical image having a relative transparency selected so as to define an area of increased transparency in said substrate resembling a graphical watermark, and wherein said transparentizing composition comprises at least one compound selected from compounds of the formula:

(I)

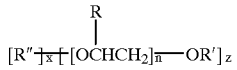

wherein

R" is any mono- or polyfunctional organic radical;

R is H or $CH_3$;

R' is H or —C(O)C(R)=$CH_2$, with the proviso that —C(O)C(R)=$CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and wherein if any of R, R', or R" are greater than one, their identities and the number of each may be the same or different;

or (II)

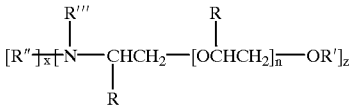

wherein

R" is any mono- or polyfunctional organic radical;

R is H or $CH_3$;

R' is H or —C(O)C(R)=$CH_2$, with the proviso that —C(O)C(R)=$CH_2$ occurs at least once;

x is an integer 0–4 and indicates the number of functional groups on R" which are reactive with ethylene or propylene oxide;

z is an integer 1–4 and may vary independently of x and n;

n is an integer 1–20 and is independent of x and z; and

R'" is H or a group of the formula

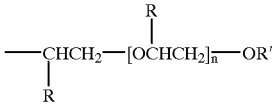

wherein

R, R', and n, are as defined as above, wherein if any of R, R', R"or R'" are greater than one, their identities and the number of each may be the same or different.

33. A cellulosic substrate having at least one transparentized portion formed therein, wherein said cellulosic substrate defines first and second major faces, said transparentized portion comprises a transparentizing composition applied to said cellulosic substrate in a predetermined pattern so as to define a graphical image having a relative transparency selected so as to define an area of increased transparency in said substrate resembling a graphical watermark, and wherein said transparentizing composition comprises:

i) a cationic catalyzable constituent selected from a vinyl ether, 2) a polyepoxide, 3) a mixture of vinyl ethers, 4) a mixture of polyepoxides, or 5) a mixture of at least one of a vinyl ether and at least one of a polyepoxide;

ii) a free radical catalyzable constituent selected from at least one compound of the Formula:

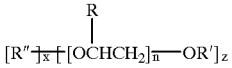

wherein,

R" is any mono- or polyfunctional organic radical;

R is H or $CH_3$;

R' is H or —C(O)C(R)═$CH_2$, with the proviso that —C(O)C(R)═$CH_2$ occurs at least once;

x is an integer 0–4 and indicates the number of functional groups on R" which are reactive with ethylene or propylene oxide;

z is an integer 1–4 and may vary independently of x and n;

n is an integer 0–20 and is independent of x and z; and wherein if any of R, R', or R" are greater than one, their identities and the number of each may be the same or different; and iii) a catalyst constituent selected from 1) a free radical catalyst, 2) a mixture of free radical catalysts, 3) a living cationic catalyst, 4) a mixture of living cationic catalysts, or 5) mixtures of at least one of a free radical catalyst and at least one of a living cationic catalyst.

34. A cellulosic substrate having at least one transparentized portion and at least one textured portion formed therein, wherein:

said cellulosic substrate defines first and second major faces;

said transparentized portion comprises a transparentizing composition applied to said cellulosic substrate in a predetermined pattern so as to define a graphical image having a relative transparency selected so as to define an area of increased transparency in said substrate;

said graphical image is further defined by said textured portion;

said area of increased transparency resembles a graphical watermark;

said transparentizing composition comprises a transparentizing agent and a security agent; and said textured portion and said transparentized portion lie in common areas of said cellulosic substrate.

35. A cellulosic substrate having at least one transparentized portion and at least one textured portion formed therein, wherein:

said cellulosic substrate defines first and second major faces;

said transparentized portion comprises a transparentizing composition applied to said cellulosic substrate in a predetermined pattern so as to define a graphical image having a relative transparency selected so as to define an area of increased transparency in said substrate;

said graphical image is further defined by said textured portion;

said area of increased transparency resembles a graphical watermark;

said transparentizing composition comprises a transparentizing agent and a security agent;

said transparentized portion includes a printed portion;

printed matter defining the printed portion is covered by said transparentizing composition; and said printed portion lies in a reduced-thickness portion of said substrate.

* * * * *

UNITED STATES PATENT AND TRADEMARK OFFICE

CERTIFICATE OF CORRECTION

PATENT NO. : 6,358,596 B1 
DATED : March 19, 2002
INVENTOR(S) : Mehta et al.

It is certified that error appears in the above-identified patent and that said Letters Patent is hereby corrected as shown below:

Column 8,
Line 46, "R'"" should be -- R''' --;

Column 12,
Line 13, "1" should be -- I --;
Line 12, under Scheme B, "$[R'']_X$ $[NH_2]$" should be -- $[R'']_X$ $[NH_2]_z$ --;

Column 25,
Line 14, "used herein" should be -- As used herein --;

Signed and Sealed this

Twenty-fourth Day of September, 2002

*Attest:*

*Attesting Officer*

JAMES E. ROGAN
*Director of the United States Patent and Trademark Office*